US008919186B2

(12) United States Patent
Kondo et al.

(10) Patent No.: US 8,919,186 B2
(45) Date of Patent: Dec. 30, 2014

(54) FUEL PRESSURE MEASURING DEVICE, FUEL PRESSURE MEASURING SYSTEM, AND FUEL INJECTION DEVICE

(75) Inventors: Jun Kondo, Nagoya (JP); Tooru Taguchi, Handa (JP); Hiroki Tanada, Kariya (JP); Akitoshi Yamanaka, Hekinan (JP)

(73) Assignee: Denso Corporation, Kariya (JP)

( * ) Notice: Subject to any disclaimer, the term of this patent is extended or adjusted under 35 U.S.C. 154(b) by 709 days.

(21) Appl. No.: 12/741,123

(22) PCT Filed: Oct. 27, 2008

(86) PCT No.: PCT/JP2008/069422

§ 371 (c)(1),
(2), (4) Date: Jul. 29, 2010

(87) PCT Pub. No.: WO2009/057543

PCT Pub. Date: May 7, 2009

(65) Prior Publication Data

US 2011/0006130 A1 Jan. 13, 2011

(30) Foreign Application Priority Data

| | | |
|---|---|---|
| Nov. 2, 2007 | (JP) | 2007-286520 |
| Feb. 19, 2008 | (JP) | 2008-037846 |
| Mar. 28, 2008 | (JP) | 2008-086990 |
| Sep. 18, 2008 | (JP) | 2008-239747 |

(51) Int. Cl.

| | |
|---|---|
| ***G01M 15/09*** | (2006.01) |
| ***F02M 47/02*** | (2006.01) |
| ***F02M 51/00*** | (2006.01) |
| ***F02M 57/00*** | (2006.01) |
| *F02D 41/38* | (2006.01) |

(52) U.S. Cl.

CPC ..... *F02M 47/027* (2013.01); *F02M 51/005* (2013.01); *F02M 57/005* (2013.01); *F02D 41/3845* (2013.01); *F02M 2200/24* (2013.01); *F02M 2547/001* (2013.01)

USPC ..... 73/114.51

(58) Field of Classification Search

USPC ..... 73/114.38, 114.42, 114.43, 114.45, 73/114.47, 114.48, 114.51

See application file for complete search history.

(56) References Cited

U.S. PATENT DOCUMENTS

| | | | |
|---|---|---|---|
| 4,438,496 | A | 3/1984 | Ohie |
| 5,988,142 | A | 11/1999 | Klopfer |

(Continued)

FOREIGN PATENT DOCUMENTS

| | | |
|---|---|---|
| JP | 57-005526 | 1/1982 |
| JP | 64-063650 | 3/1989 |

(Continued)

OTHER PUBLICATIONS

International Preliminary Report on Patentability for PCT/JP2008/069422, dated Jun. 10, 2010, 9 pages.

(Continued)

*Primary Examiner* — Eric S McCall
(74) *Attorney, Agent, or Firm* — Nixon & Vanderhye P.C.

(57) ABSTRACT

A fuel injection system for use with an internal combustion engine supplies fuel to an injector (fuel injection valve) from a common rail (accumulator) through a high-pressure pipe to spray the fuel from a spray hole formed in the injector. A thin-walled portion is formed in a path member (e.g., an injector body, the high-pressure pipe, or a connector connecting the injector and the high-pressure pipe) and defined by a locally thin wall of the path member. A strain gauge (strain sensor) is affixed to the thin-walled portion to measure strain of the thin-walled portion arising from the pressure of fuel in a high-pressure fuel path.

9 Claims, 20 Drawing Sheets

(56) References Cited

U.S. PATENT DOCUMENTS

| | | | | |
|---|---|---|---|---|
| 6,698,666 | B2 | 3/2004 | Ohata et al. | |
| 7,228,745 | B2 | 6/2007 | Kunda et al. | |
| 7,552,717 | B2 | 6/2009 | Dingle | |
| 2003/0052202 | A1 | 3/2003 | Ohata et al. | |
| 2006/0053894 | A1 | 3/2006 | Kunda et al. | |
| 2008/0228374 | A1 | 9/2008 | Ishizuka et al. | |
| 2009/0038589 | A1 | 2/2009 | Dingle | |
| 2009/0223487 | A1 | 9/2009 | Dingle | |
| 2010/0251998 | A1* | 10/2010 | Kondo et al. | 123/470 |
| 2010/0251999 | A1* | 10/2010 | Kondo et al. | 123/470 |
| 2010/0252000 | A1* | 10/2010 | Kondo et al. | 123/470 |
| 2010/0263629 | A1* | 10/2010 | Kondo et al. | 123/445 |
| 2010/0294242 | A1* | 11/2010 | Kondo et al. | 123/470 |

FOREIGN PATENT DOCUMENTS

| | | |
|---|---|---|
| JP | 2000-241273 | 9/2000 |
| JP | 2000-265892 | 9/2000 |
| JP | 2000-275128 | 10/2000 |
| JP | 2001-324402 | 11/2001 |
| JP | 2002-013994 | 1/2002 |
| JP | 2002-013997 | 1/2002 |
| JP | 2003-97378 | 4/2003 |
| JP | 2003-166457 | 6/2003 |
| JP | 2003-343329 | 12/2003 |
| JP | 2005-172761 | 6/2005 |
| JP | 2006-113041 | 4/2006 |
| JP | 2006-177860 | 7/2006 |
| JP | 2007-016678 | 1/2007 |
| JP | 2007-154700 | 6/2007 |
| JP | 2007-218249 | 8/2007 |
| JP | 2007-231770 | 9/2007 |
| JP | 2007-270822 | 10/2007 |
| JP | 1 925 803 | 5/2008 |
| JP | 2008-144749 | 6/2008 |
| WO | WO 99/32783 | 1/1999 |
| WO | WO 2009/019663 | 2/2009 |
| WO | WO 2009/05742 | 5/2009 |
| WO | WO 2009/057540 | 5/2009 |
| WO | WO 2009/057541 | 5/2009 |

OTHER PUBLICATIONS

International Search Report for PCT/JP2008/069422, mailed Jan. 20, 2009.

U.S. Application No. 12/265,743, Kondo et al, filed Nov. 6, 2008.

U.S. Application No. 12/265,745, Kondo et al, filed Nov. 6, 2008.

U.S. Application No. 12/265,772, Kondo et al, filed Nov. 6, 2008.

Extended Supplemental European Search Report dated Feb. 17, 2011 issued in corresponding European Application No. 08844545.7-2311.

* cited by examiner

FUEL PRESSURE MEASURING DEVICE, FUEL PRESSURE MEASURING SYSTEM, AND FUEL INJECTION DEVICE

This application is the U.S. National Phase of International Application No. PCT/JP2008/069422, filed 27 Oct. 2008, which designated the U.S. and claims priority to Japanese Application No. (s) 2008-086990, filed 28 Mar. 2008, 2008-239747, filed 18 Sep. 2008, 2007-286520, filed 2 Nov. 2007 and 2008-037846, filed 19 Feb. 2008, the entire contents of each of which are hereby incorporated by reference.

TECHNICAL FIELD

The present invention relates generally to a fuel pressure measuring device, a fuel pressure measuring system, and a fuel injection device to measure the pressure of fuel in a fuel injection system for an internal combustion engine into which the fuel, as supplied from an accumulator, is sprayed by a fuel injection valve.

BACKGROUND ART

In order to ensure the accuracy in controlling output torque of internal combustion engines and the quantity of exhaust emissions therefrom, it is essential to control a fuel injection mode such as the quantity of fuel to be sprayed from a fuel injector or the injection timing at which the fuel injector starts to spray the fuel. For controlling such a fuel injection mode, there have been proposed techniques for sensing a change in pressure of the fuel resulting from spraying thereof from the fuel injector.

For instance, the time when the pressure of the fuel begins to drop due to the spraying thereof from the fuel injector may be used to determine an actual injection timing at which the fuel has been sprayed actually. The amount of drop in pressure of the fuel arising from the spraying thereof may be used to determine the quantity of fuel sprayed actually from the fuel injector. The detection of such an actual fuel injection mode ensures the accuracy in controlling the fuel injection mode based on a detected value.

When such a change in pressure of the fuel is measured by a fuel pressure sensor (i.e., a rail pressure sensor) installed directly in a common rail (i.e., an accumulator), it will be absorbed within the common rail, thus resulting in a decrease in accuracy in determining such a pressure change. In the invention, as taught in the patent document 1, the fuel pressure sensor is disposed in a joint between the common rail and a high-pressure pipe through which the fuel is delivered from the common rail to the fuel injection valve to measure the change in pressure of the fuel before it is absorbed within the common rail.

Patent Document 1: Japanese Patent First Publication No. 2000-265892

DISCLOSURE OF THE INVENTION

Problem to be Solved by the Invention

In the patent document 1, the fuel pressure sensor is installed in the joint of the high-pressure pipe to the common rail, while the inventors of this application have studied the installation of the pressure sensor in the fuel injector. Specifically, a stem (i.e., an elastic body) to which a strain gauge is affixed is installed in a body of the fuel injection valve in which a high-pressure fuel path is formed to measure the amount by which the stem is deformed when subjected to the pressure of the high-pressure fuel. The stem and the strain gauge constitute the fuel pressure sensor.

The above structure in which the strain gauge is attached to the stem results in an increase in size of the body by the stem. Additionally, a sealing structure is needed to seal between the stem and the body in order to avoid the leakage of the high-pressure fuel from between the stem and the body, thus resulting in a complex structure. This problem is also countered in the case where the fuel pressure sensor is disposed in a place other than the fuel injection valve. The installation of the fuel pressure sensor in a path member defining the high-pressure fuel path results in a difficulty in avoiding an increase in size of the path member. The sealing structure is needed to seal between the path member and the stem.

The invention was made in order to solve the above problems. It is an object of the invention to provide a fuel pressure measuring device, a fuel pressure sensing system, and a fuel injection device which measure the pressure of fuel flowing through a high-pressure fuel path formed in a path member and are designed to avoid an increase in size of the path member and has a simplified structure.

SUMMARY

Means for solving the problem, operations thereof, and effects, as provided thereby will be described below.

A first example embodiment is used in a fuel injection system for an internal combustion engine which supplies fuel from an accumulator in which the fuel is accumulated to a fuel injection valve through a high-pressure pipe and sprays the fuel from a spray hole formed in the fuel injection valve, characterized in that it comprises: a thin-walled portion which is formed in a path member defining a high-pressure fuel path extending from an outlet of the accumulator to the spray hole and defined by a locally thin wall thickness of the path member; and a strain sensor which is installed on the thin-walled portion to measure strain of the thin-walled portion arising from pressure of the fuel in the high-pressure fuel path.

The thin-walled portion is formed in the path member. The strain sensor is affixed directly to the thin-walled portion, thus eliminating the need for the above stem constructed as being separate from the path member and enables the pressure of fuel in the high-pressure fuel path to be measured. This avoids an increase in size of the path member arising from installation of a fuel pressure measuring device. The above described stem requires the sealing structure because it needs to be in contact with the high-pressure fuel. The strain sensor of this invention does not need it, thus resulting in a simplified structure of the fuel pressure measuring device.

A second example embodiment is characterized in that the thin-walled portion is formed in a portion of the path member which define a side surface of the high-pressure fuel path. This facilitates the ease of machining the thin-walled portion.

A third example embodiment is characterized in that the fuel injection valve has a body defining a portion of the high-pressure fuel path, and the thin-walled portion is formed in the body. This enables the pressure of fuel to be measured near the spray hole as compared with the case where the thin-walled portion is formed in a portion of the path member (e.g., the high-pressure pipe) upstream of the fuel injection valve, thus ensuring the accuracy in measuring a variation in pressure of the fuel arising from the spraying of the fuel.

A fourth example embodiment is characterized in that it comprises a temperature sensor working to measure a temperature of the thin-walled portion or a temperature correlating thereto, and a value measured by the strain sensor is corrected as a function of a value measured by the temperature sensor.

The amount by which the thin-walled portion strains has different values depending upon the temperature of the thin-walled portion even though the actual pressure of the fuel is constant. In view of this, the invention, as recited in the fourth example embodiment, is characterized in that it comprises a temperature sensor working to measure the temperature of the thin-walled portion or the temperature correlating thereto, and the value measured by the strain sensor is corrected as a function of the value measured by the temperature sensor. The value measured by the strain sensor is corrected as a function of the temperature of the thin-walled portion when the pressure of fuel is measured, thus resulting in a decrease in error of the value measured by the strain sensor arising from the temperature of the thin-walled portion.

In view of the fact that the correlation between the temperature of the thin-walled portion and the temperature of the fuel is high, the invention, as recited in a fifth example embodiment, is characterized in that the temperature sensor is installed in the high-pressure fuel path or the accumulator to measure the temperature of the fuel. This improves the degree of freedom of installation of the temperature sensor as compared with the case where the temperature of the thin-walled portion is measured directly. Specifically, it is, as described in claim 6, preferable that the temperature sensor is installed in the accumulator.

The structure of the invention, as recited in the first example embodiment, wherein the strain sensor is installed on the thin-walled portion, is concerned about the ease with which the relation between the actual pressure of fuel and the measured pressure of fuel has an individual variability as compared with the case where a strain gauge is attached to a stem. Specifically, the thin-walled portion which is made by cutting the path member is susceptible to the individual variability as compared with the stem is separate from the path member. In view of this concern, the invention, as recited in the seventh example embodiment, is characterized in that it comprises storage means for storing a relation between an actual pressure of fuel when supplied to said high-pressure fuel path and a resulting value, as measured by the strain sensor, as a fuel pressure characteristic value. This enables the value measured by the strain sensor to be corrected base on the fuel pressure characteristic value stored in the storage means, thereby eliminating the error of the measured value arising from the individual variability.

The amount by which the thin-walled portion strains has different values depending upon the temperature of the thin-walled portion even though the actual pressure of the fuel is constant. In view of this, the invention, as recited in an eighth example embodiment, is characterized in that it comprises storage means for storing a relation between a temperature of the thin-walled portion or a temperature correlating thereto and a resulting value, as measured by the strain sensor, as a temperature characteristic value. The value measured by the strain sensor is corrected as a function of the temperature of the thin-walled portion when the pressure of fuel is measured based on the temperature characteristic value stored in the storage means, thus eliminating the error of the measured value arising from the temperature.

A ninth example embodiment is a fuel pressure measuring system equipped with at least one of a fuel injection valve which is installed in an internal combustion engine and sprays fuel from a spray hole and a high-pressure pipe which supplies high-pressure fuel to said fuel injection, and the above fuel measuring device. This provides the same effects as described above.

A tenth example embodiment is characterized in that it comprises: a fluid path to which high-pressure fluid is supplied externally; a spray hole connected to the fluid path to spray at least a portion of the high-pressure fluid; a pressure control chamber to which a portion of the high-pressure fluid is supplied from the fluid path and produces force urging a nozzle needle which opens or closes the spray hole in a valve-closing direction; a diaphragm which is coupled directly or indirectly to the pressure control chamber and strainable and displaceable at least partially by pressure of the high-pressure fluid; and displacement measuring means for measuring a displacement of the diaphragm.

The diaphragm is connected directly or indirectly to the pressure control chamber, thus eliminating the need for a special tributary to connect the diaphragm to the fluid path. Therefore, when the pressure sensing portion is disposed inside the injector body, an increase in diameter of the injector body is avoided.

A portion of the high-pressure fluid is supplied to and accumulated in the high-pressure chamber, thereby producing force in the pressure control chamber which urges the nozzle needle in the valve-closing direction. This stops the spraying of the fuel. When the high-pressure fuel, as accumulated in the pressure control chamber, is discharged so that the pressure therein drops, the nozzle needle is opened, thereby initiating the spraying of the fuel from the spray hole. The time the internal pressure in the pressure control chamber changes substantially coincides with that the fuel is sprayed form the spray hole. Therefore, in the invention, the diaphragm is joined directly or indirectly to the pressure control chamber. The displacement measuring means measures the displacement of the diaphragm, thus ensuring the accuracy in measuring the time the spraying is made from the spray hole.

In another example embodiment a branch path is provided which communicates with the pressure control chamber. The diaphragm is made of a thin-walled portion communicating with the branch path. This eliminates the need for a special tributary to connect the branch path to the fluid path. Therefore, when the pressure sensing portion is disposed inside the injector body, an increase in diameter of the injector body is avoided.

An eleventh example embodiment is characterized in that it comprises an injector body in which the fluid path and the spray hole are formed and a separate member which is formed to be separate from the injector body and disposed inside the injector body, and in that the separate member includes therein the branch path communicating with the pressure control chamber and the thin-walled portion communicating with the branch path. Specifically, the branch path communicating with the pressure control chamber and the thin-walled portion are disposed inside the separate member formed to be separate from the injector body, thus facilitating the ease of machining the diaphragm. This also facilitates controlling of the thickness of the diaphragm as compared with the effects of the tenth example embodiment, thereby improving the accuracy in measuring the pressure.

A twelfth example embodiment is characterized in that the separate member includes an inner orifice into which the high-pressure fluid is delivered, a pressure control chamber space which communicates with the inner orifice and constitutes a portion of the pressure control chamber, and an outer orifice which communicates with the pressure control chamber space and discharges the high-pressure fluid to a low-pressure path, and in that the branch path communicates with the pressure control chamber space in the separate member, and the diaphragm connects with the branch path and is formed in the separate member. The branch path communicating with the pressure control chamber and the diaphragm are disposed in the separate member formed to be separate from the injector body, thus facilitating the ease of machining or forming the diaphragm. This also facilitates controlling the thickness of the diaphragm as compared with the effects of the tenth example embodiment, thus ensuring the accuracy in measuring the pressure.

A thirteenth example embodiment is characterized in that the branch path connects with a portion of the pressure control chamber space which is different from that to which the inner orifice and the outer orifice connect. The flow of the high-pressure fluid in the inner orifice and the outer orifice is fast, thus resulting in a time lag until a change in pressure is in the steady state. However, the present invention uses the above structure, thus enabling a change in the pressure to be measured in a range in which the flow in the pressure control chamber is in the steady state.

A fourteenth example embodiment is characterized in that the separate member includes a first member equipped with the inner orifice, the pressure control chamber space, and the outer orifice, and a second member which is stacked directly or indirectly on the first member within the injector body, has the connection path and the branch path, and in which the diaphragm connects with a portion of the branch path which is different from that to which the connection path connects.

The thin-walled portion is in the second member formed to be separate from the injector body, thus facilitating the ease of machining or forming the diaphragm. This also facilitates controlling the thickness of the diaphragm, thus ensuring the accuracy in measuring the pressure. Further, the second member including the diaphragm is stacked on the first member defining the portion of the pressure control chamber, thus avoiding an increase in diameter of the injector body.

A fifteenth example embodiment is characterized in that the second member is made of a plate member having a given thickness, the displacement measuring means includes a strain measuring device installed on a surface of the diaphragm of the second member which is opposite a surface thereof to which the high-pressure fluid is introduced, and the diaphragm is located at a depth of at least a thickness of the strain measuring device below a surface of the second member.

The diaphragm is located at the depth of at least the thickness of the strain measuring device below the surface of the second member, thus avoiding the stress on the strain measuring device when the second member is disposed in the injector body. This facilitate the installation of the pressure sensing portion in the second member.

The diaphragm may be, as described in a sixteenth example embodiment, made of a thin-walled portion formed in a portion of an inner wall defining the pressure control chamber. This enables a change in the pressure in the pressure control chamber to be measured without any time lag.

A seventeenth example embodiment is characterized in that it comprises an injector body in which the fluid path and the spray hole are formed and a separate member which is formed to be separate from the injector body and disposed inside the injector body, and in that the separate member is equipped with the pressure control chamber having a thin-walled portion smaller in wall thickness than another portion thereof. This enables a change in the pressure in the pressure control chamber to be measured without any time lag.

An eighteenth example embodiment is characterized in that the separate member includes an inner orifice into which the high-pressure fluid is delivered, a pressure control chamber space which communicates with the inner orifice and constitutes a portion of the pressure control chamber, an outer orifice which communicates with the pressure control chamber space and discharges the high-pressure fluid to a low-pressure path, and the thin-walled portion provided by a portion of the pressure control chamber space.

The thin-walled portion is provided by the portion of the pressure control chamber space in the separate member formed to be separate from the injector body, thus facilitating the ease of machining or forming the diaphragm. This also facilitates controlling the thickness of the diaphragm as compared with the effects of the invention of a tenth example embodiment, thus ensuring the accuracy in measuring the pressure.

A nineteenth example embodiment is characterized in that the diaphragm is formed in a portion of the pressure control chamber space which is different from the inner and outer orifices. The flow of the high-pressure fluid in the inner orifice and the outer orifice is fast, thus resulting in a time lag until a change in pressure is in the steady state. However, the present invention uses the above structure, thus enabling a change in the pressure to be measured in a range in which the flow in the pressure control chamber is in the steady state.

A twentieth example embodiment is characterized in that the separate member is made of a plate member having a given thickness, the displacement measuring means includes a strain measuring device installed on a surface of the diaphragm of the separate member which is opposite a surface thereof to which the high-pressure fluid is introduced, and the diaphragm is located at a depth of at least a thickness of the strain measuring device below a surface of the separate member.

The diaphragm is located at the depth of at least the thickness of the strain measuring device below the surface of the second member, thus avoiding the stress on the strain measuring device when the second member is disposed in the injector body. This facilitate the installation of the pressure sensing portion in the second member.

A twenty-first example embodiment is characterized in that the separate member is made of a plate member disposed substantially perpendicular to an axial direction of the injector body.

The separate member is formed by the plate member disposed substantially perpendicular to the axial direction of the injector body, thus avoiding an increase in diameter of the injector body when the pressure sensing portion is installed in the separate member.

A twenty-second example embodiment is characterized in that it comprises a control piston which transmits a force to the nozzle needle to urge the nozzle needle in a valve-closing direction, and in that the control piston has an upper end exposed to the pressure control chamber in the injector body so that the upper end is subjected to force, as produced in the pressure control chamber, and the upper end is located at a given distance L away from an opening of the branch path toward the spray hole when the spray hole is opened.

When the upper end of the control piston is located farther from the spray hole than the branch path upon the valve opening, it may cause the control piston to cover the branch path. In such an event, the displacement measuring means measures a change in pressure in the pressure control chamber only after the pressure in the pressure control chamber rises, so that the control piston is moved in the valve-closing direction to open the branch path, thus resulting in a time loss until the pressure is measured. In contrast, the present invention uses the above structure to keep the branch path communicating with the pressure control chamber at all times even when the spray hole is opened.

It is, like in the twenty-third example embodiment, preferable that the pressure control chamber includes an inner orifice into which the high-pressure fluid is delivered from the fluid path, a pressure control chamber space which communicates with the inner orifice, and an outer orifice which communicates with the pressure control chamber space and discharges the high-pressure fluid to a low-pressure path, and the diaphragm connects with the pressure control chamber space.

BRIEF DESCRIPTION OF THE DRAWINGS

FIG. 9(*b*) is a plan view of FIG. 9(*a*);

FIG. 9(*c*) is a sectional view of a pressure sensing member according to the fifth embodiment;

FIG. 9(*d*) is a plan view of FIG. 9(*c*);

FIG. 9(*e*) is a sectional view of a modification of a pressure sensing member of FIG. 9(*c*);

FIG. 10(*b*) is an A-A sectional view of FIG. 10(*a*);

FIG. 13(*b*) is a B-B sectional view of FIG. 13(*a*);

FIG. 13(*c*) is a C-C sectional view of FIG. 13(*a*);

FIG. 14(*b*) is a plan view of FIG. 14(*a*);

FIG. 14(*c*) is a partial sectional view which shows highlights of a pressure sensing member of the seventh embodiment;

FIG. 14(*d*) is a plan view of FIG. 14(*c*);

FIG. 14(*e*) is a sectional view which shows a positional relation between a control piston and a pressure sensing member when being installed in an injector body;

FIG. 15(*b*) is a plan view of FIG. 15(*a*);

FIG. 15(*c*) is a partial sectional view which shows highlights of a pressure sensing member;

FIG. 15(*d*) is a plan view of FIG. 15(*c*);

FIG. 15(*e*) is a sectional view which shows a positional relation between a control piston and a pressure sensing member when being installed in an injector body;

FIG. 15(*a*) is a partial sectional view which shows highlights of an orifice member (pressure sensing member) of an injector for a fuel injection device according to the ninth embodiment;

FIG. 16(*c*) is a sectional view which shows a positional relation between a control piston and a pressure sensing member when being installed in an injector body;

FIG. 16(*d*) is a sectional view which shows a modification f a pressure sensing member;

FIG. 17(*b*) is a plan view of FIG. 17(*a*);

FIG. 19(*b*) is a plan view of FIG. 19(*a*);

FIG. 19(*c*) is a partially sectional view which shows highlights of a pressure sensing member;

FIG. 19(*d*) is a plan view of FIG. 19(*c*);

FIG. 20(*b*) is a B-B sectional view of FIG. 20(*a*);

FIG. 20(*c*) is a C-C sectional view of FIG. 20(*a*);

FIG. 21(*b*) is a plan view of FIG. 21(*a*);

FIG. 21(*c*) is a partially sectional view which shows highlights of a pressure sensing member;

FIG. 21(*d*) is a plan view of FIG. 21(*c*);

FIG. 22(*b*) is a plan view of FIG. 22(*a*);

FIG. 22(*c*) is a sectional view of a modification of the orifice member of FIG. 22(*a*);

FIG. 23(*b*) is a plan view of FIG. 23(*a*).

EXPLANATION OF REFERENCE NUMBER

Figure 1:
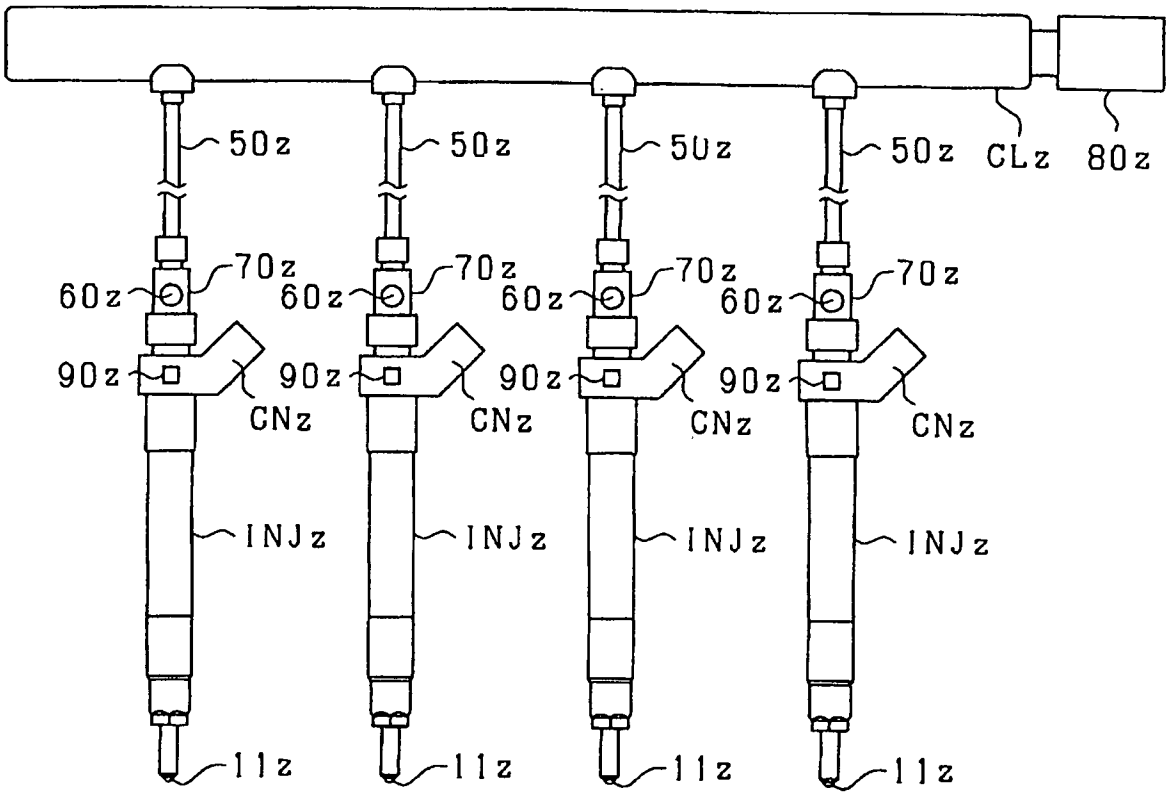
FIG. 1 is a view which shows injectors joined to a common rail in the first embodiment of the invention.

4*z*—injector body (path member)
4*az*, 31*az*, 12*az*—high-pressure fuel path
12*z*—nozzle body (path member)
31*z*—valve body (path member)
50*z*—high-pressure pipe (path member)
60*z*—strain gauge (strain sensor)
70*z*—connector (path member)
70*az*—communication path
70*bz*, 43*bz*, 4*cz*, 43*dz*—thin-wailed portion Cbz—common rail (accumulator)
INJz—fuel injection valve
11—lower body
11*b*—fuel supply path (first fluid path)
11*c*—fuel induction path (second fluid path)
11*d*—storage hole
11*f*—coupling (inlet)
11*g*—fuel supply branch path
12—nozzle body
12*a*—valve seat
12*b*—spray hole
12*c*—high-pressure chamber (fuel sump)
12*d*—fuel feeding path
12*e*—storage hole
13—bar filter
14—retaining nut (retainer)
16—orifice member
161—valve body-side end surface
162—plat surface
16*a*—communication path (outlet side orifice, outer orifice)
16*b*—communication path (inlet side orifice, inner orifice)
16*c*—communication path (pressure control chamber)
16*d*—valve seat
16*e*—fuel release path
16*g*—guide hole
16*h*—inlet
16*k*—gap
16*p*—through hole
16*r*—fuel leakage groove
17—valve body
17*a*, 17*b*—through hole
17*c*—valve chamber
17*d*—low-pressure path (communication path)
18*a*—groove (branch path)
18*b*—pressure sensing chamber
18*c*—communication path (pressure control chamber)
18*d*—processing substrate
18*e*—electric wire
18*f*—pressure sensor
18*g*—lower body
18*h*—sensing portion communication path
18*k*—glass layer
18*m*—gauge
18*n*—diaphragm
18*p*—through hole
18*q*—other surface
18*r*—single-crystal semiconductor chip
18*s*—through hole
18*t*—positioning member
19*c*—wire, pad,
19*d*—oxide film
102—fuel tank
103—high-pressure fuel pump
104—common rail
105—high-pressure fuel path
106—low-pressure fuel path
107—electronic control device (ECU)
108—fuel pressure sensor
109—crank angle sensor
110—accelerator sensor
2—injector
20—nozzle needle
21—fluid induction portion
22—injector
30—control piston
30*c*—needle
30*p*—outer end wall
31—annular member
32—injector
35—spring
37—fuel path
301—nozzle
302—piezo-actuator (actuator)
303—back pressure control mechanism
308—holding member
321—housing
322—piezoelectric device
323—lead wire
331—valve body
335—high-pressure seat surface
336—low-pressure seat surface
341, 341*a* to 341*c*—storage hole
41—valve member
41*a*—spherical portion
42—valve armature
50—connector
51*a*, 51*b*—terminal pin
52—upper body
53—upper housing
54—intermediate housing
59—urging member (spring)
61—coil
62—spool
63—stationary core
64—stopper
7—solenoid valve device
8—back pressure chamber (pressure control chamber)
80, 85, 87—pressure sensing portion
81, 86—pressure sensing member (fuel pressure sensor)
82—plate surface
92—positioning member

BEST MODE FOR CARRYING OUT THE INVENTION

Each embodiment embodying the invention will be described below based on drawings. In the following embodiments, the same reference numbers are appended to the same or like parts in the drawings.

First Embodiment

Figure 2:
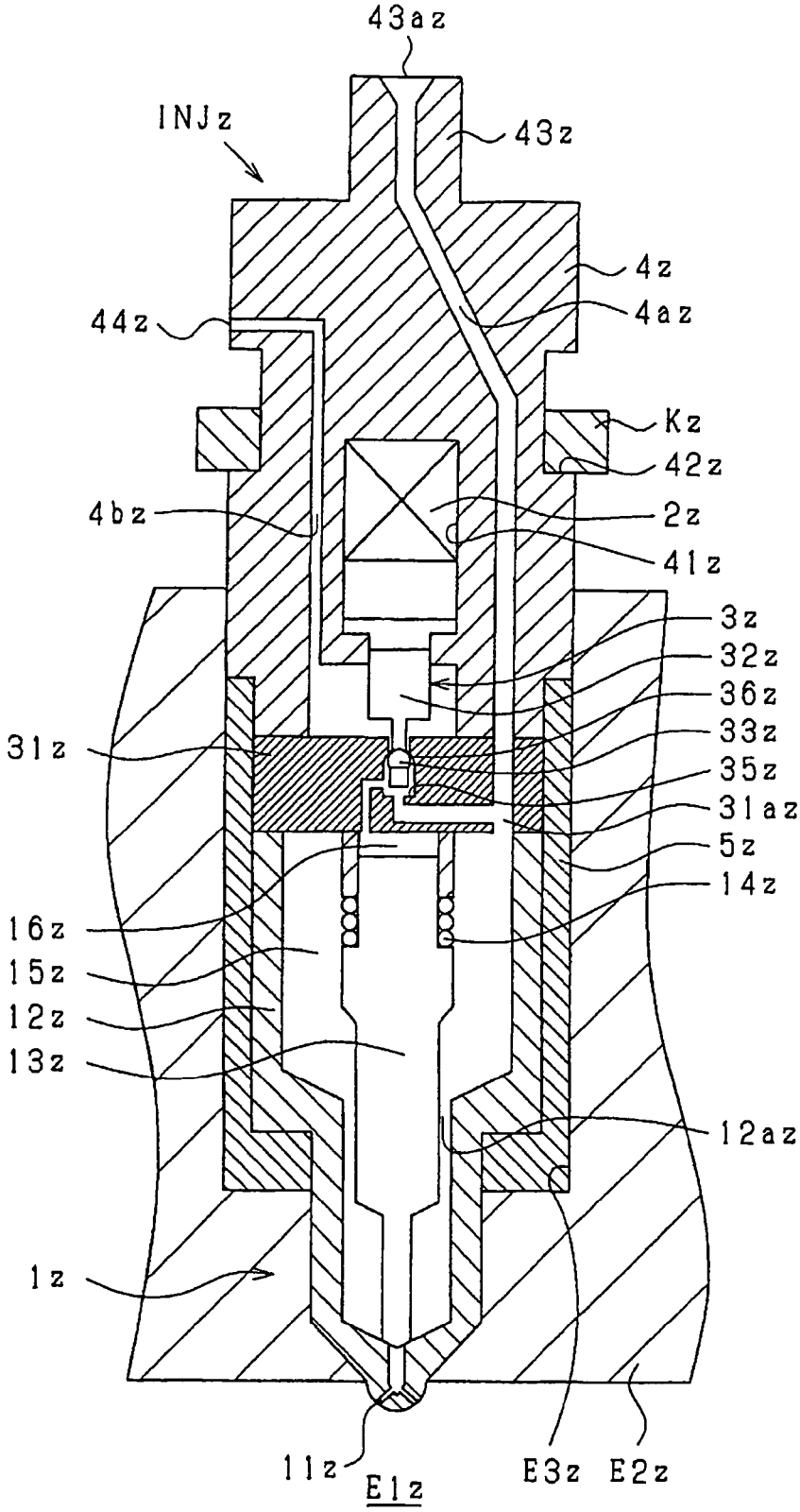
FIG. 2 is a sectional view which shows an internal structure of an injector according to the first embodiment of the invention.
Figure 3:
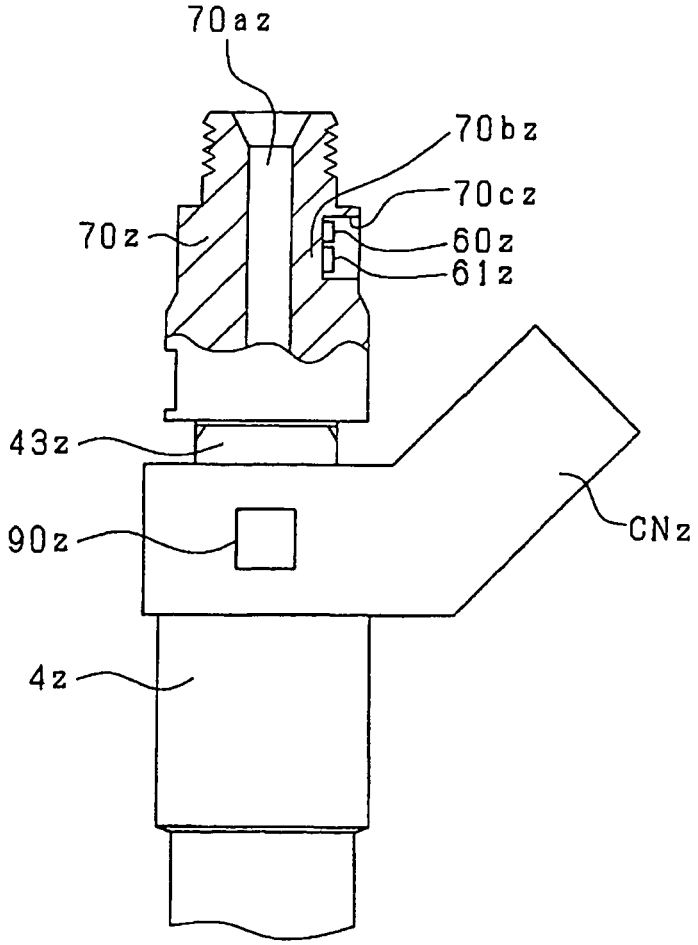
FIG. 3 is a view which shows a location of installation of a strain gauge according to the first embodiment.

The first embodiment of the invention will be described using FIGS. 1 to 3. FIG. 1 is a view which shows injectors INJz (i.e., a fuel injection valve) of this embodiment which are joined to a common rail CLz (i.e., an accumulator). FIG. 2 is a sectional view which shows one of the injectors INJz. FIG. 3 is a view which shows a mount structure of a strain gauge 60*z* (i.e., a strain sensor).

The basic structure and operation of the injector will be described based on FIGS. 1 and 2. The injector INJz works to spray high-pressure fuel, as accumulated in the common rail CLz, into a combustion chamber E1*z* formed in a cylinder of an internal combustion engine. The injector INJz is installed in a cylinder head E2*z* of the engine.

This embodiment is made for a diesel engine (i.e., an internal combustion engine) for four-wheel automobiles which is of a type in which high-pressure fuel (e.g., light fuel) is to be injected directly into the combustion chamber E1*z* at an atmospheric pressure of, for example, 1000 or more. The engine is also a multi-cylinder four-stroke reciprocating diesel engine (e.g., an in-line four-cylinder engine). To the common rail CLz, the high-pressure fuel, as fed from a fuel tank through a fuel pump (not shown), is supplied at high pressure.

The injector INJz includes a nozzle 1z which sprays fuel upon valve-opening, a piezo actuator 2z, and a back pressure control mechanism 3z. The piezo actuator 2z expands or contracts when charged or discharged. The back pressure control mechanism 3z is driven by the piezo actuator 2z to control the back pressure acting on the nozzle 1z. Instead of the piezo actuator 2z, a solenoid coil may be employed to actuate the back pressure control mechanism 3z. Alternatively, in place of the back pressure control mechanism 3z, the injector INJz may be designed as a direct-acting fuel injector in which an actuator opens or closes the nozzle 1z directly.

The nozzle 1z is made up of a nozzle body 12z (path member) in which spray holes 11z are formed, a needle 13z, and a spring 14z. The needle 13z is to be moved into or out of abutment with a seat of the nozzle body 12z to close or open the spray holes 11z. The spring 14z works to urge the needle 13z in a valve-closing direction.

The piezo actuator 2z is made of a stack of piezoelectric devices (which is usually called a piezo stack). The piezoelectric devices are capacitive loads which expand or contact through the piezoelectric effect. When charged, the piezo stack expands, while when discharged, the piezo stack contracts. Specifically, the piezo stack serves as an actuator to move the needle 13z. The piezo actuator 2z is supplied with electric power from conductors (not shown) joined to an electric connector CNz, as illustrated in FIG. 1.

Within a valve body 31z (path member) of the back pressure control mechanism 3z, a piston 32z and a valve body 33z are disposed. The piston 32z is moved by the contraction or expansion of the piezo actuator 2z to drive the valve body 33z. The valve body 31z is illustrated as being made of a single member, but actually formed by a plurality of parts.

The substantially cylindrical injector body 4z (path member) has formed therein a stepped cylindrical storage hole 41z which is formed in a radially central portion thereof and extends in an injector axial direction (i.e., a vertical direction, as viewed in FIG. 2). The piezo actuator 2z and the back pressure control mechanism 3z are disposed in the storage hole 41z. A hollow cylindrical retainer 5z is threadably fitted to the injector body 4z to secure the nozzle 1z to the end of the injector body 4z.

The injector body 4z, the valve body 31z, and the nozzle body 12z have formed therein high-pressure fuel paths 4az, 31az, and 12az into which the fuel is delivered at a high pressure from the common rail CLz at all times. The injector body 4z and the valve body 31z have formed therein a low-pressure path 4bz leading to the fuel tank (not shown). The nozzle body 12z, the injector body 4z, and the valve body 31z are each made of metal and installed in a insertion hole E3z formed in a cylinder head E2z of the internal combustion engine. The injector body 4z has an engagement portion 42z (press surface) with which an end of a clamp Kz is to engage. The other end of the clamp Kz is fastened to the cylinder head E2z through a bolt to press the engagement portion 42z into the insertion hole E3z, thereby fixing the injector in the insertion hole E3z in a pressed state.

A high-pressure chamber 15z (high-pressure fuel path) is formed between the outer peripheral surface of the needle 13z and the inner peripheral surface of the nozzle body 12z. When the needle 13z is moved in a valve-opening direction, it establishes a communication between the nozzle chamber 15z and the spray holes 11z. The nozzle chamber 15z is supplied with the high-pressure fuel at all the time through the high-pressure fuel path 31az. A back-pressure chamber 16z is formed by one of ends of the needle 13z which is far from the spray holes 11z. The spring 14z is as described above, disposed within the back-pressure chamber 16z.

The valve body 31z has formed therein a high-pressure seat surface 35z in a path communicating between the high-pressure fuel path 31az of the valve body 31z and the back-pressure chamber 16z of the nozzle 1z. The valve body 31z has also formed therein a low-pressure seat surface 36z in a path communicating between the low-pressure fuel path 4bz in the valve body 31z and the back-pressure chamber 16z in the nozzle 1z. The valve body 33z is disposed between the high-pressure seat surface 35z and the low-pressure seat surface 36z.

The injector body 4z has a high-pressure port 43z (connector joint) which is joined to a high-pressure pipe 50z through a connector 70z, as will be described later, (see FIGS. 1 and 3) and a low-pressure port 44z (leakage pipe joint) which is joined to a low-pressure pipe (leakage pipe). The high-pressure port 43z may be, as illustrated in FIG. 2, located farther away from the spray holes 11 than the clamp Kz, but alternatively be located closer to the spray holes 11 than the clamp Kz. The high-pressure port 43z may be, as illustrated in FIG. 2, formed in an axial end (a vertical direction in FIG. 2) of the injector body 4z or in a side surface of the injector body 4z.

In the above structure, the high-pressure fuel, as accumulated in the common rail CLz, is delivered from outlets of the common rail CLz, provided one for each cylinder, and supplied to the high-pressure ports 43z through the high-pressure fuel pipes 50z and the connectors 70z. The high-pressure fuel then passes through the high-pressure fuel paths 4az and 31az and enters the high-pressure chamber 15z and the back pressure chamber 16z. When the piezoelectric actuator 2z is in a contracted state, the valve body 33z is, as illustrated in FIG. 2, urged into abutment with the low-pressure seat surface 36z to establish the communication between the back-pressure chamber 16z and the high-pressure fuel path 31az, so that the high-pressure fuel is supplied to the back-pressure chamber 16z. The pressure of the high-pressure fuel in the back-pressure chamber 16z and the elastic pressure, as produced by the spring 14z, act on the needle 13z to urge it in the valve-closing direction to close the spray holes 11z.

Alternatively, when the piezoelectric actuator 2z is charged so that it expands, the valve body 33z is pushed into abutment with the high-pressure seat surface 35z to establish the communication between the back-pressure chamber 16z and the low-pressure fuel path 4bz, so that the pressure in the back-pressure chamber 16z drops, thereby causing the needle 13z to be urged by the pressure of fuel in the high-pressure chamber 15z in the valve-opening direction to open the spray holes 11z to spray the fuel into the combustion chamber E1z.

Next, a sequence of steps of joining the injectors INJz, the connectors 70z, and the high-pressure pipes 50z to the cylinder head E2z will be described briefly below.

First, the injector INJz is inserted into the insertion hole E3z of the cylinder head E2z. The clamp Kz is fastened by a bolt into the cylinder head E2z to mount the injector INJz in the cylinder head E2z. Next, the connector 70z in which the strain gauge 60z is already mounted on the thin wall 70bz is joined to the high-pressure pipe 30z. Next, the connector 70z to which the high-pressure pipe 50z is joined is coupled to the high-pressure port 43z of the injector INJz. By this sequence of steps, the installation of the injector INJz, the connector 70z, and the high-pressure pipe 50z in the cylinder head E2z is completed. After the same sequence of steps is made for all the cylinders, the high-pressure pipe 50z for each cylinder is joined to the common rail CLz. In the above discussion, after the high-pressure pipe 50z is joined to the connector 70z, the injector INJz is joined to the connector 70z, but however, the high-pressure pipe 50*z* and the connector 70*z* are joined together after the injector INJz and the connector 70*z* are joined together.

The spraying of the fuel from the spray holes 11*z* will result in a variation in pressure of the high-pressure fuel. The strain gauge 60*z* working to measure such a fuel pressure variation is installed the connector 70*z*. The time when the fuel has started to be sprayed actually may be found by sampling the time when the pressure of fuel has started to drop due to the spraying of the fuel from the waveform of the variation in the pressure, as measured by the strain gauge 60*z*. The time when the fuel has stopped from being sprayed actually may be found by sampling the time when the pressure of fuel has started to rise due to the termination of the spraying of fuel from the waveform of the variation in the pressure. The quantity of fuel having been sprayed may be found by sampling the amount by which the fuel has dropped in addition to the injection start time and the injection termination time. In other words, the strain gauge 60*z* works to detect a change in injection rate arising from the spraying of fuel.

Next, the strain gauges 60*z* and the mount structure of the connectors 70*z* will be described below with reference to FIG. 3.

The connector 70*z* is made of metal and to be installed between the high-pressure port 43*z* of the fuel injector INJz and the high-pressure pipe 50*z*. The connector 70*z* is of a hollow cylindrical shape and extends in a direction of an axial line of the fuel injector INJz (i.e., a vertical direction in FIG. 3). The inside of the cylinder functions as a communication path 70*az* which communicates between the fuel inlet 43*az* formed in the high-pressure port 43*z* (see FIG. 2) and the outlet 50*az* of the high-pressure pipe 50*z*.

A side surface portion of the connector 70*z* (path member) adjacent the communication path 70*az* (high-pressure fuel path), that is, a cylindrical portion of the connector 70*z* has formed therein a thin-walled portion 70*bz* which has an extremely thin wall thickness. The strain gauge 60*z* is affixed to the outer peripheral surface of the thin-walled portion 70*bz* (i.e., the surface far from the communication path 70*az*). In other words, the thin-walled portion 70*bz* is made by forming a recess 70*cz* in the outer peripheral surface of the connector 70*z*. The strain gauge 60*z* is disposed in the recess 70*cz*.

Within the recess 70*c*, circuit components 61*z* constituting a voltage applying circuit and an amplifying circuit, as will be described later, are also disposed. These circuits are joined to the strain gauge 60*z* by wire bonding. The strain gauge 60*z* to which the voltage is applied by the voltage applying circuit constitute a bridge circuit along with resistors (not shown) and has a resistance value which changes as a function of the degree of strain occurring in the thin-walled portion 70*bz*. This causes an output voltage of the bridge circuit to change as a function the degree of strain of the thin-walled portion 70*bz*, which is, in turn, outputted as a measured pressure value of the high-pressure fuel to the amplifying circuit. The amplifying circuit amplifies the measured pressure value outputted from the strain gauge 60*z* (i.e., the bridge circuit) and outputs an amplified signal.

Although an actual pressure of the fuel is constant, the amount by which the thin-walled portion 70*bz* strains depends upon an instant temperature of the thin-walled portion 70*bz*. Consequently, in this embodiment, the measured pressure value is temperature-corrected, as discussed below. First, tests are performed in which a know temperature and pressure of fuel are supplied to the communication path 70*az* to measure an instant pressure through the strain gauge 60*z*. The correlation between the temperature of the thin-walled portion 70*b* and the temperature of the fuel is high. The temperature of the fuel is, therefore, measured instead of the temperature of the thin-walled portion 70*bz*. This measurement is performed experimentally within an assumed temperature range. A relation between the actual temperature of the fuel and the measured pressure is acquired as a temperature characteristic value. The temperature characteristic value is stored in a QR (trade mark) code as a storage means. The QR code 90*z* is attached to the injector INJz (see FIG. 1).

The temperature characteristic value held in the QR code is read in a scanner and then stored in an engine ECU (not shown) which controls operations of the injectors INJz. After the injectors INJz are mounted in an internal combustion engine and shipped from a factory, the ECU corrects the measured pressure, as outputted from the strain gauge 60*z*, using the stored temperature characteristic value and the measured value of the temperature of the fuel. The temperature of the fuel is measured by a temperature sensor 80*z* (see FIG. 1) installed in the common rail CLz.

Further, in this embodiment, a variation in the measured pressure due to an individual variability is also corrected in the following manner. First, the fuel is supplied to the communication path 70*az* at a known pressure (i.e., an actual pressure). An instantaneous pressure is measured by the stain gauge 60*z*. This measurement is performed experimentally within an assumed pressure range. A relation between the actual pressure and the measured pressure is acquired as a fuel pressure characteristic value. The fuel pressure characteristic value is stored in the QR code 90*z*. The fuel pressure characteristic value held in the QR code is read in the scanner and then stored in the engine ECU. After the injectors INJz are mounted in the internal combustion engine and shipped from the factory, the ECU corrects the measured pressure, as outputted from the strain gauge 60*z*, using the stored fuel pressure characteristic value.

The above described embodiment offers the following beneficial effect.

(1) The connector 70*z* which connects between the injector INJz and the high-pressure pipe 50*z* has the thin-walled portion 70*b* to which the strain gauge 60*z* is affixed directly. This enables the pressure of fuel in the communication path 70*z* to be measured without need for the above described stem formed to be separate from the connector 70*z*. The installation of the fuel pressure measuring device, therefore, avoids an increase in size of the connector 70*z*. The above described, stem needs to be exposed to the high-pressure fuel, thus requiring the sealing structure, but the strain gauge 60*z* (i.e., the strain sensor) of this embodiment does not need that, thus resulting in a simplified structure of the fuel pressure measuring device.

(2) If the strain gauge 60*z* is affixed to the inner peripheral surface (i.e., the surface facing the communication path 70*az*) of the thin-walled portion 70*bz*, it requires the need for a mount hole for taking lead wires (not shown) of the strain gauge 60*z* from inside to outside the connector 70*z*. The structure for sealing between the mount hole and the lead wires of the strain gauge 60*z* is also needed. However, in this embodiment, the strain gauge 60*z* is attached to the outer peripheral surface (i.e., the surface far from the communication path 70*az*) of the thin-walled portion 70*bz*, thus eliminating the need for the mount hole and the sealing structure.

(3) The above described structure in which the strain gauge 60*z* is affixed to the thin-walled portion 70*bz* is concerned about the ease with which the relation between the actual pressure of fuel and the measured pressure of fuel (i.e., the fuel pressure characteristic value) has an individual variability as compared with the case where the strain gauge is attached to the stem. Specifically, the thin-walled portion

70*bz* which is made by cutting the connector 70*z* susceptible to the individual variability due to a machining error as compared with the stem is separate from the connector 70*z*, which leads to concern about a variation in the fuel pressure characteristic value. In order to alleviate this concern, the fuel pressure characteristic value, as derived experimentally, is stored in the QR code 90*z* to correct the pressure, as measured by the strain gauge 60*z* based on the fuel pressure characteristic, thus eliminating an error in the measured pressure arising from the individual variability.

(4) The temperature characteristic value, as derived experimentally, is stored in the QR code 90*z* to correct the pressure, as measured by the strain gauge 60*z*, based on the temperature characteristic value and the temperature of fuel, as measured by the temperature sensor 80*z*, thus minimizing an error in the measured pressure resulting from the temperature of the thin-walled portion 70*bz*.

(5) The connector 70*z* is disposed between the high-pressure port 43*z* of the injector INJz and the high-pressure pipe 50*z*. The strain gauge 60*z* is affixed to the connector 70*z* to measure the pressure of high-pressure fuel. This enables use of a portion of space where the high-pressure pipe 50*z* is installed for installation of the connector 70*z* and the strain gauge 60*z*. This avoids an increase in size of the injector INJz for installation of the stain gauge 60*z* and minimizes the space required for installation of the strain gauge 60*z*.

(6) The connector 70*z* is designed to be separate from the injector body 4*z* and coupled with the injector INJz detachably, thus permitting the injectors INJz to be installed in the cylinder head E2*z* independently from the connector 70*z*. This improves the workability to install the injectors INJz to the engine.

(7) The connector 70*z* is designed to be separate from the injector body 4*z* and coupled with the injector INJz detachably, thus permitting typical injectors in a fuel injection system which do not have the strain gauge 60*z* downstream of the common rail CLz to be designed as being identical in structure with and employed as the injectors INA.

Second Embodiment

Figure 4:
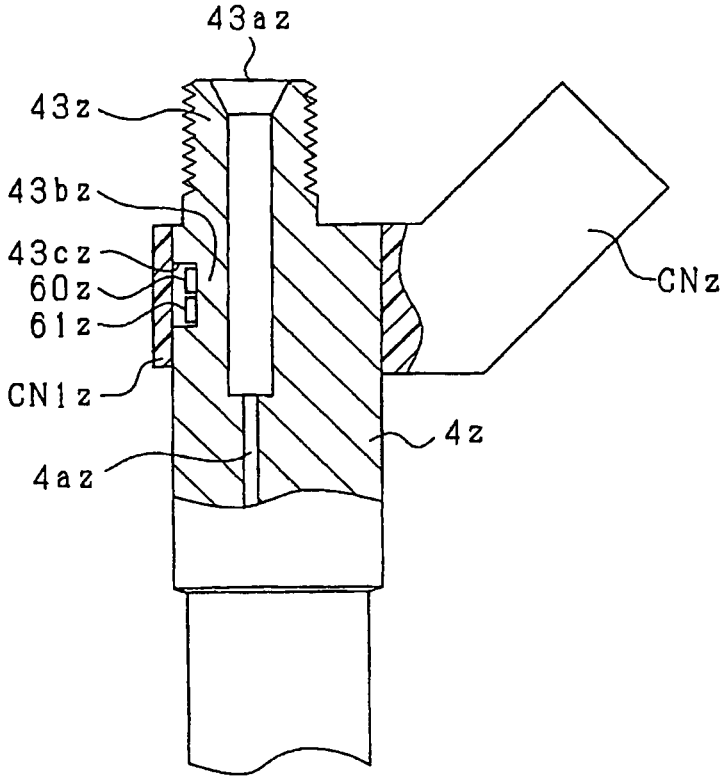
FIG. 4 is a view which shows a location of installation of a strain gauge according to the second embodiment of the invention.

In the first embodiment, the connector 70*z* which connects between the injector INJz and the high-pressure pipe 50*z* has the thin-walled portion 70*bz*. In this embodiment, as illustrated in FIG. 4, the injector body 4*z* (path member) has the thin-walled portion 43*bz*.

Specifically, a side surface portion of the high-pressure fuel path 4*az* of the injector body 4*z* adjacent the high-pressure port 43*z* has formed therein the thin-walled portion 43*bz* which has a locally thin wall thickness. The strain gauge 60*z* is affixed to the outer peripheral surface of the thin-walled portion 43*bz* (i.e., the surface far from the high-pressure fuel path 4*az*). In other words, the injector body 4*z* has formed in the outer peripheral surface thereof a recess 43*cz* to define the thin-walled portion 43*bz*. The strain gauge 60*z* and circuit components 61*z* are disposed in the recess 43*cz*.

The electric connector CNz has an engaging portion CN1 extending along the outer peripheral surface of the injector body 4*z* in the form of an annular shape. The engaging portion CN1 engages the injector body 4*z* to retain the electric connector CNz on the injector body 4*z*. The recess 43*cz* is closed by the engaging portion CN1*z*, thereby covering the strain gauge 60*z* and the circuit components 61*z* with the engaging portion CN1*z*.

The above structure of this embodiment has the same effects as those in the first embodiment. Additionally, the strain gauge 60*z* and the circuit components 61*a* are covered with the engaging portion CM1*z* of the electric connector CNz, thus permitting parts to be decreased as compared with the case where a special cover is used for the strain gauge 60*z* and the circuit components 61*z*. The strain gauge 60*z* is located near the electric connector CNz, thus facilitating the ease of connecting the lead wires (not shown) of the strain gauge 60*z* to terminals in the electric connector CNz. In other words, the electric connector may be shared between the strain gauge 60*z* and the piezo-actuator 2*z*.

The thin-walled portion 43*bz* is located nearer the spray holes 11*z* than the thin-walled portion 70*bz* of the first embodiment, thus enhancing the accuracy in measuring a change in pressure of fuel resulting from the spraying of the fuel from the spray holes 11*z*.

Third Embodiment

Figure 5:
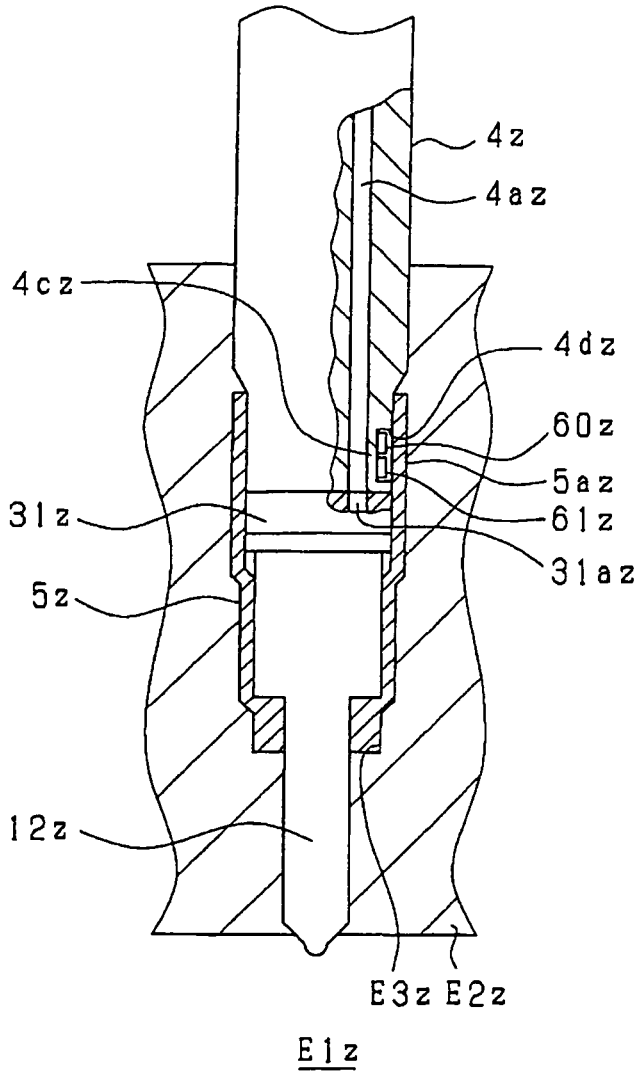
FIG. 5 is a view which shows a location of installation of a strain gauge according to the third embodiment of the invention.

The injector INJz is, as described above, mounted in the insertion hole E3*z* of the cylinder head E2*z*. The second embodiment has the thin-walled portion 43*bz* formed in the injector body 4*z* outside the insertion hole E3*z*. In this embodiment, as illustrated in FIG. 5, the thin-walled portion 4*cz* is formed in a portion of the injector body 4*z* which is located inside the insertion hole E3*z*.

Specifically, the thin-walled portion 4*cz* is formed at the most downstream location of the high-pressure fuel path 4*az* in the injector body 4*z*. The strain gauge 60*z* is affixed to the outer peripheral surface of the thin-walled portion 4*cz* (i.e., the surface far from the high-pressure fuel path 4*az*). In other words, the injector body 4*z* has formed in the outer peripheral surface thereof a recess 4*dz* to define the thin-walled portion 4*cz*. The strain gauge 60*z* and circuit components 61*z* are disposed in the recess 4*dz*.

The lead wires (not shown) joined to the strain gauge 60*z* may be arrayed between the injector body 4*z* and the insertion hole E3*z*. A wiring path may alternatively be formed inside the injector body 4*z*. For example, the wiring path may be defined by the low-pressure path 4*b*.

As already described using FIG. 2, the nozzle 1*z* is held on the end portion of the injector body 4*z* by threadably fastening the retainer 5*z* to the injector body 4*z*. In this embodiment, the retainer 5*z* has an extension 5*az* extending in an axial direction. The extension 5*az* closes the recess 4*dz* to cover the strain gauge 60*z* and the circuit components 61*z*.

The above structure of this embodiment has the same effects as those in the first embodiment. Additionally, the strain gauge 60*z* and the circuit components 61*a* are covered with the extension 5*az* of the retainer 5*z*, thus permitting parts to be decreased as compared with the case where a special cover is used for the strain gauge 60*z* and the circuit components 61*z*.

The thin-walled portion 4*cz* is located nearer the spray holes 11*z* than the thin-walled portion 43*bz* of the second embodiment, thus enhancing the accuracy in measuring a change in pressure of fuel resulting from the spraying of the fuel from the spray holes 11*z*.

Fourth Embodiment

Figure 6:
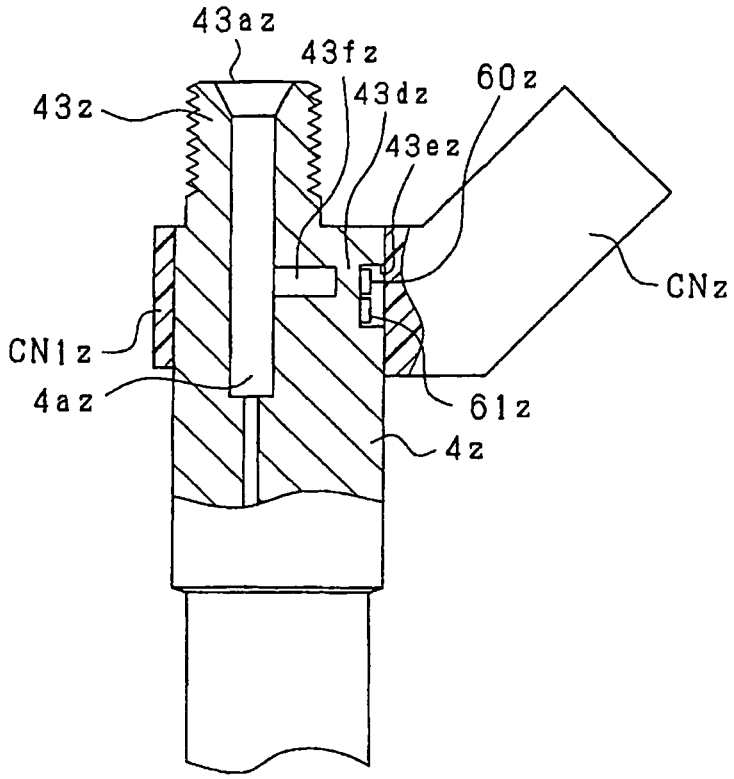
FIG. 6 is a view which shows a location of installation of a strain gauge according to the fourth embodiment of the invention.

The thin-walled portions 70*bz*, 43*bz*, and 4*cz* in the above embodiments are formed in the side surface portion of the high-pressure path 70*az* or 4*az* of the connector 70*z* or the injector body 4*z* (path member). In this embodiment, as illustrated in FIG. 6, the branch path 43*fz* is formed which diverges from the high-pressure fuel path 4*az*. The thin-walled portion 4*dz* is formed in an end portion of the branch path 43*fz* in the injector body 4*z*. This results in almost no flow of the fuel in the branch path 43*fz* which is bifurcated from the high-pressure fuel path 4*az* to deliver the fuel the high-pressure fuel to the thin-walled portion 43*dz*. The strain gauge 60*z* measures the high-pressure fuel in the branch path 43*fz* in which the fuel hardly flows, thus avoiding the deterioration of accuracy in measuring the pressure of fuel which arises from the flow of the fuel.

Fifth Embodiment

Figure 7:
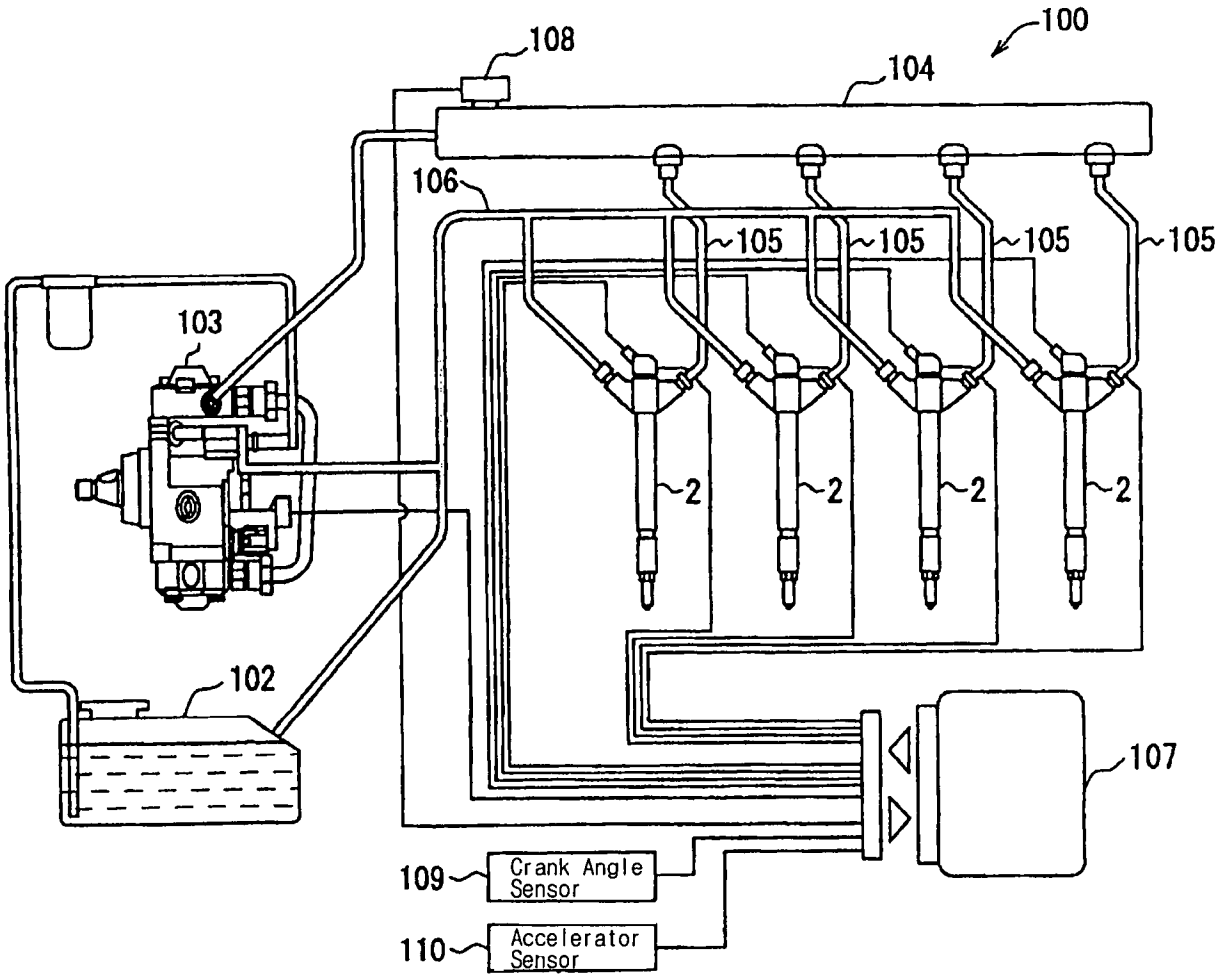
FIG. 7 is a schematic view of a structure in which an injector for a fuel injection device of the fifth embodiment of the invention is installed in a common rail system.
Figure 8:
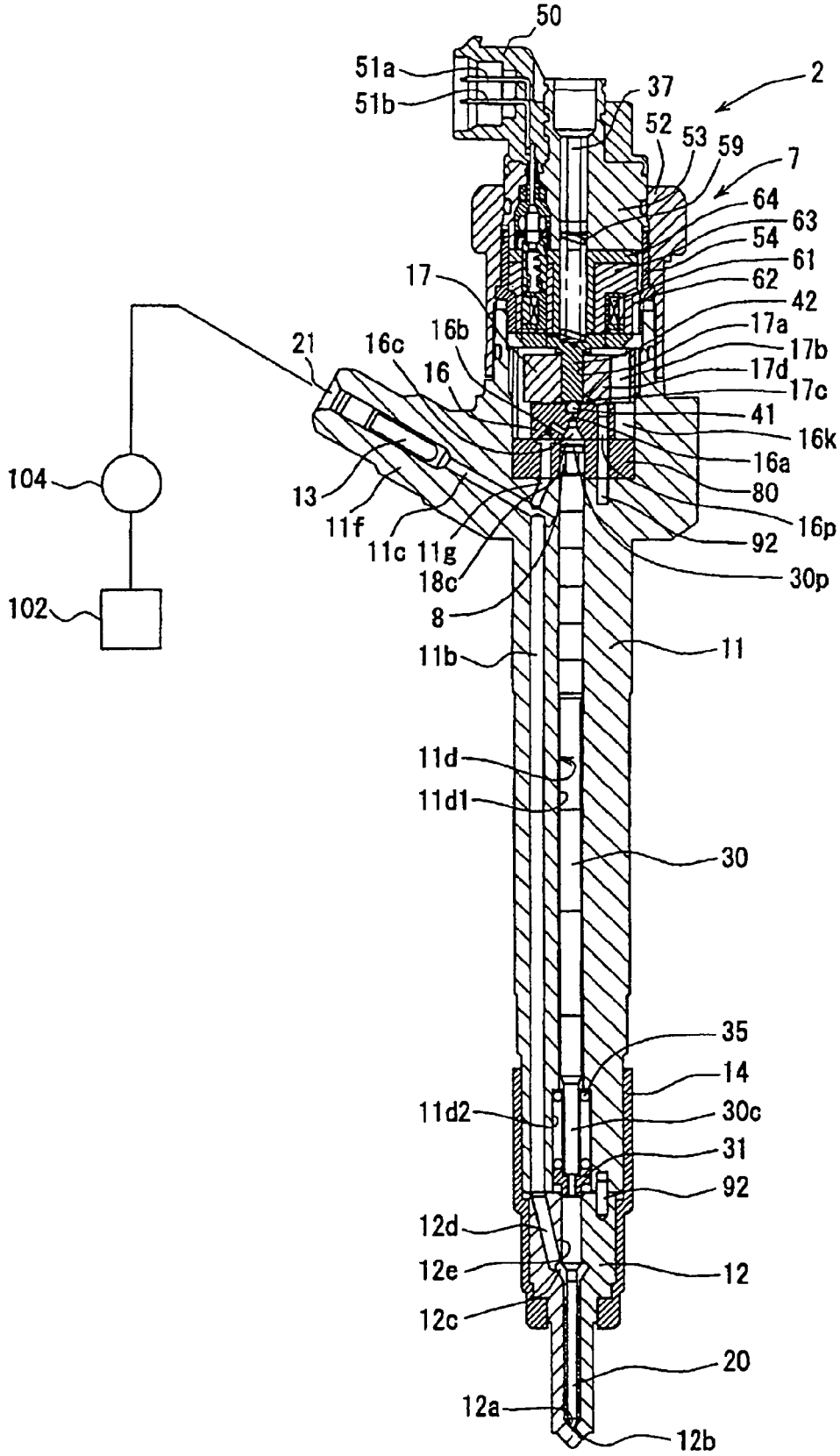
FIG. 8 is a sectional view of an injector for a fuel injection device according to the fifth embodiment.
Figure 9:
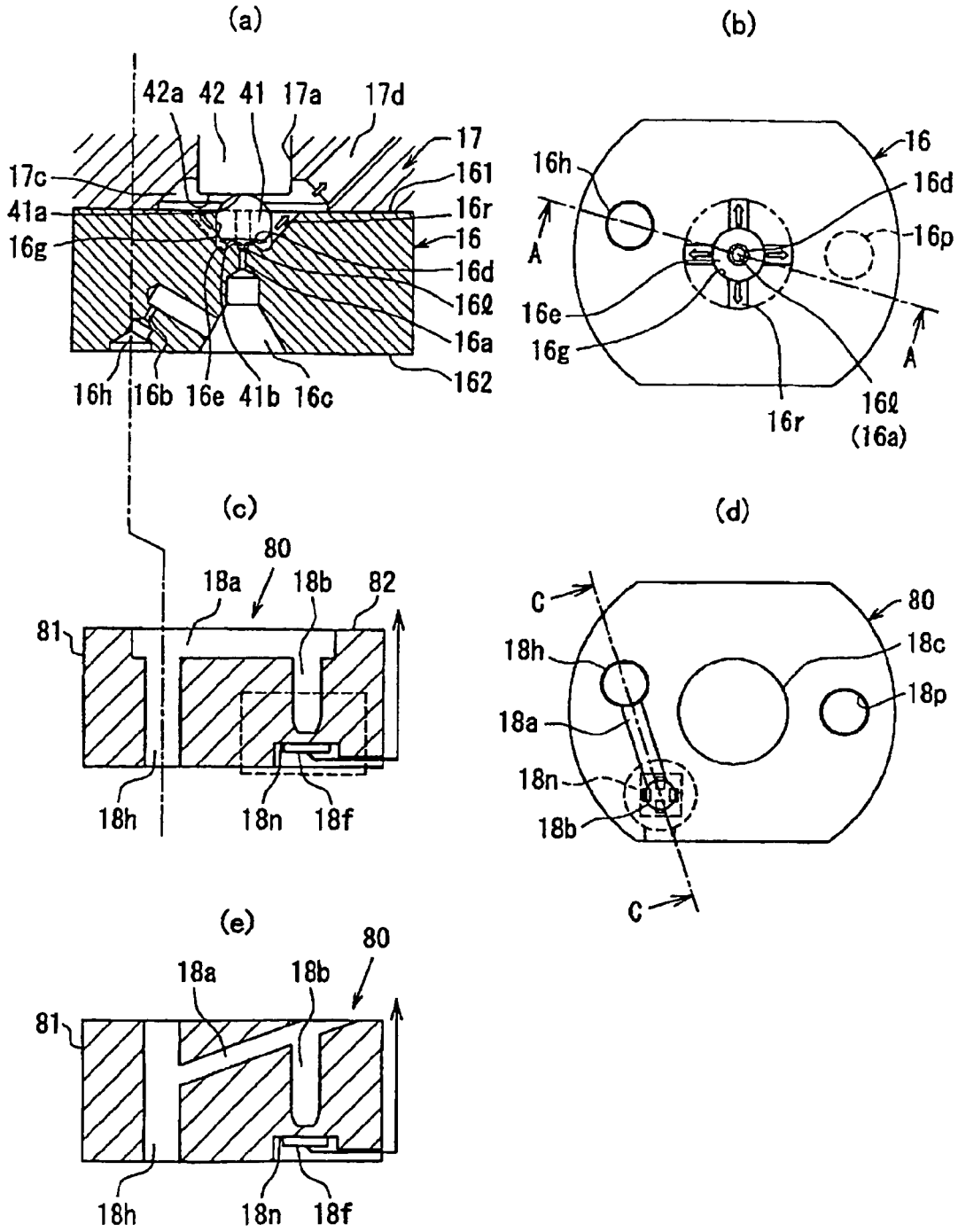
FIG. 9(*a*) is a sectional view of an orifice member in the fifth embodiment.
Figure 10:
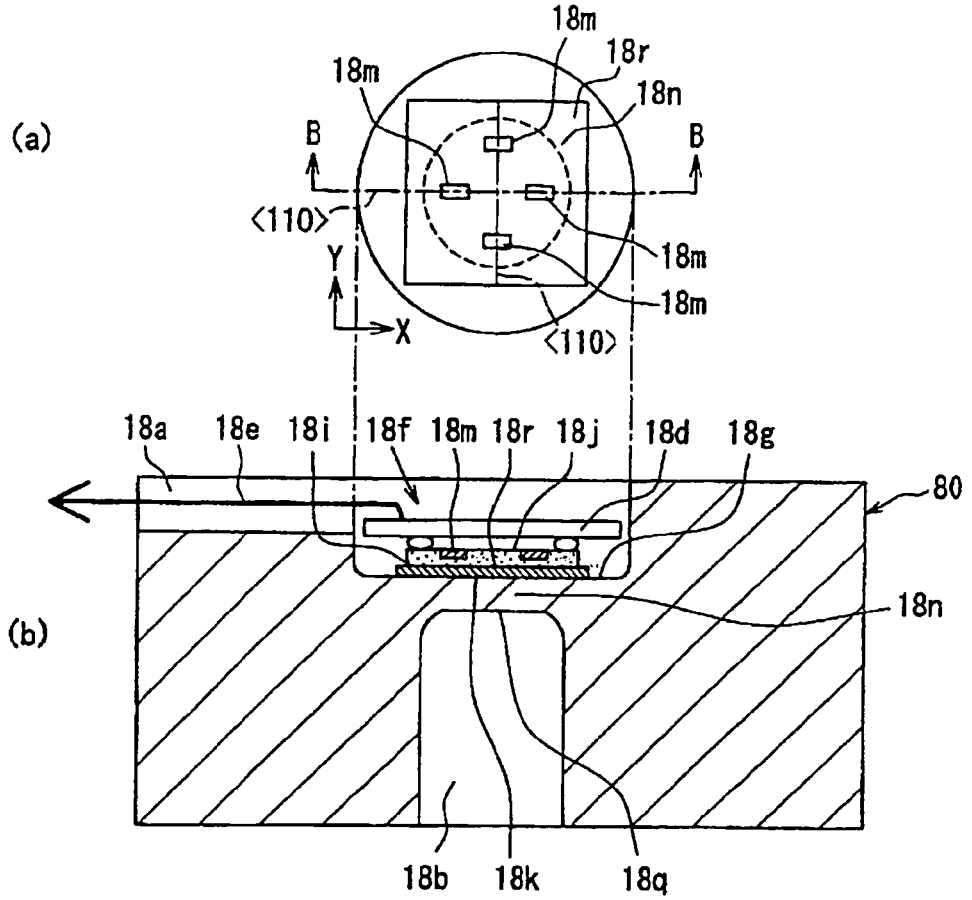
FIG. 10(*a*) is an enlarged plan view near a diaphragm of a pressure sensing member in the fifth embodiment.
Figure 11:
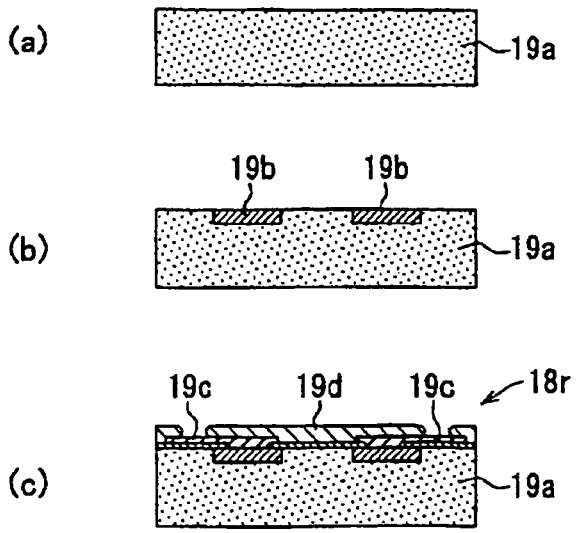
FIGS. 11(*a*)-11(*c*) are a sectional views which shows a production method of a fuel pressure sensor in the fifth embodiment.

FIG. 7 is a whole structure view of an accumulator fuel injection system 100 including the above diesel engine. FIG. 8 is a sectional view which shows the injector 2 according to this embodiment. FIGS. 9(*a*) and 9(*b*) are partial sectional view and a plane view which illustrate highlights of a fluid control valve in this embodiment. FIGS. 9(*c*) to 9(*e*) are partially sectional views and a plane view which show highlights of a pressure sensing member. FIGS. 10(*a*) and 10(*b*) are a sectional view and a plane view which illustrate highlights of the pressure sensing member. FIGS. 11(*a*) to 11(*c*) are sectional views which illustrate a production method of the pressure sensor. The fuel injection system 100 of this embodiment will be described below with reference to the drawings.

The fuel pumped out of the fuel tank 102 is, as illustrated in FIG. 7, pressurized by the high-pressure supply pump (which will be referred to as a supply pump below) 103 and delivered to the common rail 104. The common rail 104 stores the fuel, as supplied from the supply pump 103, at a high pressure and supplies it to the injectors 2 through high-pressure fuel pipes 105, respectively. The injectors 2 are installed one in each of cylinders of a multi-cylinder diesel engine (which will be referred to as an engine below) mounted in an automotive vehicle and work to inject the high-pressure fuel (i.e., high-pressure fluid), as accumulated in the common rail 104, directly into a combustion chamber. The injectors 2 are also connected to a low-pressure fuel path 106 to return the fuel back to the fuel tank 102.

An electronic control unit (ECU) 107 is equipped with a typical microcomputer and memories and works to control an output from the diesel engine. Specifically, the ECU 107 samples results of measurement by a fuel pressure sensor 108 measuring the pressure of fuel in the common rail 104, a crank angle sensor 109 measuring a rotation angle of a crankshaft of the diesel engine, an accelerator position sensor 110 measuring the amount of effort on an accelerator pedal by a user, and pressure sensing portions 80 installed in the respective injectors 2 to measure the pressures of fuel in the injectors 2 and analyzes them.

The injector 2, as illustrated in FIG. 8, includes a nozzle body 12 retaining therein a nozzle needle 20 to be movable in an axial direction, a lower body 11 retaining therein a spring 35 working as urging means to urge the nozzle needle 20 in a valve-closing direction, a retaining nut 14 working as a fastening member to fastening the nozzle body 12 and the lower body 11 through an axial fastening pressure, a solenoid valve device 7, and the pressure sensing portion 80. The nozzle body 12, the lower body 11, and the retaining nut 14 form a nozzle body of the injector with the nozzle body 12 and the lower body 11 fastened by the retaining nut 14. In this embodiment, the lower body 11 and the nozzle body 12 form an injector body. The nozzle needle 20 and the nozzle body 12 forms a nozzle.

The nozzle body 12 is substantially of a cylindrical shape and has at least one spray hole 12*b* formed in a head thereof (i.e., a lower end, as viewed in FIG. 8) for spraying a jet of fuel into the combustion chamber.

The nozzle body 12 has formed therein a storage hole 12*e* (which will be referred to as a first needle storage hole below) within which the solid-core nozzle needle 20 is retained to be slidable in the axial direction thereof. The first needle storage hole 12*e* has formed in a middle portion thereof, as viewed vertically in the drawing, a fuel sump 12*c* which increases in a hole diameter. Specifically, the inner periphery of the nozzle body 12 defines the first needle storage hole 12*e*, the fuel sump 12*c*, and a valve seat 12*a* in that order in a direction of flow of the fuel. The spray hole 12*b* is located downstream of the valve seat 12*a* and extends from inside to outside the nozzle body 12.

The valve seat 12*a* has a conical surface and continues at a large diameter side to the first needle storage hole 12*e* and at a small diameter side to the spray hole 12*b*. The nozzle needle 20 is seated on or away from the valve seat 12*a* to close or open the nozzle needle 20.

The nozzle body 12 also has a fuel feeding path 12*d* extending from an upper mating end surface thereof to the fuel sump 12*c*. The fuel feeding path 12*d* communicates with a fuel supply path 11*b*, as will be described later in detail, formed in the lower body 11 to deliver the high-pressure fuel, as stored in the common rail 104, to the valve seat 12*a* through the fuel sump 12*c*. The fuel feeding path 12*d* and the fuel supply path 11*b* define a high-pressure fuel path.

The lower body 11 is substantially of a cylindrical shape and has formed therein a storage hole 11*d* (which will also be referred to as a second needle storage hole below) within which the spring 35 and a control piston 30 which works to move the nozzle needle 20 are disposed to be slidable in the axial direction of the lower body 11. An inner circumference 11*d*2 is formed in a lower mating end surface of the second needle storage hole 11*d*. The inner circumference 11*d*2 is expanded more than a middle inner circumference 11*d*1.

Specifically, the inner circumference 11*d*2 (which will also be referred to as a spring chamber below) defines a spring chamber within which the spring 35, an annular member 31, and a needle 30*c* of the control piston 30 are disposed. The annular member 31 is interposed between the spring 35 and the nozzle needle 20 and serves as a spring holder on which the spring 35 is held to urge the nozzle needle 20 in the valve-closing direction. The needle 30*c* is disposed in direct or indirect contact with the nozzle needle 20 through the annular member 31.

The lower body 11 has a coupling 11*f* (which will be referred to as an inlet below) to which the high-pressure pipe, as illustrated in FIG. 7, connecting with a branch pipe of the common rail 104 is joined in an air-tight fashion. The coupling 11*f* is made up of a fluid induction portion 21 at which the high-pressure fuel, as supplied from the common rail 104, enters and a fuel inlet path 11*c* (will also be referred to as a second fluid path) through which the fuel is delivered to the fuel supply path 11*b* (will also be referred to as a first fluid path). The fuel inlet path 11*c* has a bar filter 13 installed therein. The fuel supply path 11*b* extends in the inlet 11*f* and around the spring chamber 11*d*2.

The lower body 11 also has a fuel drain path (which is not shown and also referred to as a leakage collecting path) through which the fuel in the spring chamber 11*d*2 is returned to a low-pressure fuel path such as the fuel tank 102, as illustrated in FIG. 10. The fuel drain path and the spring chamber 11*d*2 form the low-pressure fuel path.

As illustrated in FIG. 8, on the other end side of the control piston 30, pressure control chambers 8 and 16*c* (which will be referred to as hydraulic control chambers) are defined to which the hydraulic pressure is supplied by the solenoid-operated valve device 7.

The hydraulic pressure in the hydraulic pressure control chambers 8 and 16*c* is increased or decreased to close or open the nozzle needle 20. Specifically, when the hydraulic pressure is drained from the hydraulic pressure control chambers 8 and 16*c*, it will cause the nozzle needle 20 and the control piston 30 to move upward, as viewed in FIG. 8, in the axial direction against the pressure of the spring 35 to open the spray hole 12*b*. Alternatively, when the hydraulic pressure is supplied to the hydraulic pressure control chambers 8 and 16*c* so that it rises, it will cause the nozzle needle 20 and the control piston 30 to move downward, as viewed in FIG. 9, in the axial direction by the pressure of the spring 35 to close the spray hole 12*b*.

The pressure control chambers 8, 16*c*, and 18*e* are defined by an outer end wall (i.e., an upper end) 30*p* of the control piston 30, the second needle storage hole 11*d*, an orifice member 16, and a pressure sensing member 81 (corresponding to a path member). When the spray hole 12*b* is opened, the upper end wall 30*p* lies flush with a flat surface 82 of the pressure sensing member 81 placed in surface contact with the orifice block 16 or is located closer to the spray hole 12*b* than the flat surface 82. In other words, when the spray hole 12*b* is opened, the upper end wall 30*p* is disposed inside the pressure control chamber 18*c* of the pressure sensing member 81.

Next, the solenoid-operated valve 7 will be described in detail. The solenoid-operated valve 7 is an electromagnetic two-way valve which establishes or blocks fluid communication of the pressure control chambers 8, 16*c*, and 18*c* with a low-pressure path 17*d* (which will also be referred to as a communication path below). The solenoid-operated valve 7 is installed on a spray hole-opposite end of the lower body 11. The solenoid-operated valve 7 is secured to the lower body 11 through an upper body 52. The orifice member 16 is disposed on the spray hole-opposite end of the second needle storage hole 11*d* as a valve body.

The orifice member 16 is preferably made of a metallic plate (a first member) extending substantially perpendicular to an axial direction of the fuel injector 2, that is, a length of the control piston 30. The orifice member 16 is machined independently (i.e., in a separate process or as a separate member) from the lower body 11 and the nozzle body 12 defining the injector body and then installed and retained in the lower body 11. The orifice member 16, as illustrated in FIGS. 9(*a*) and 9(*b*), has communication paths 16*a*, 16*b*, and 16*c* formed therein. FIG. 9(*b*) is a plan view of the orifice member 16, as viewed from a valve armature 42. The communication paths 16*a* 16*b*, and 16*c* (which will also be referred to as orifices below) work as an outer orifice defining an outlet, an inner orifice defining an inlet, and the control chamber 16*c* which leads to the second needle chamber 11*d*.

The outer orifice 16*a* communicates between the valve seat 16*d* and the pressure control chamber 16*c*. The outer orifice 16*a* is closed or opened by a valve member 41 through the valve armature 42. The inner orifice 16*b* has an inlet 16*h* opening at the flat surface 162 of the orifice member 16. The inlet 16*h* communicates between the pressure control chamber 16*c* and a fuel supply branch path 11*g* through a sensing portion communication path 18*h* formed in the pressure sensing member 81. The fuel supply branch path 11*g* diverges from the fuel supply path 11*b*.

The valve seat 16*d* of the orifice body 16 on which the valve member 41 is to be seated and the structure of the valve armature 42 will be described later in detail.

The valve body 17 serving as a valve housing is disposed on the spray hole-far side of the orifice member 16. The valve body 17 has formed on the periphery thereof an outer thread which meshes with an inner thread formed on a cylindrical threaded portion of the lower body 11 to nip the orifice member 16 between the valve body 17 and the lower body 11. The valve body 17 is substantially of a cylindrical shape and has through holes 17*a* and 17*b* (see FIG. 8). The communication path 17*d* is formed between the through holes 17*a* and 17*b*. The hole 17*a* will also be referred to as a guide hole below.

The valve body-side end surface 161 of the orifice member 16 and the inner wall of the through hole 17*a* define a valve chamber 17*c*. The orifice member 16 has formed on an outer wall thereof diametrically opposed flats (not shown). A gap 16*k* formed between the flats and the inner wall of the lower body 11 communicates with the through holes 17*b* (see FIG. 8).

The pressure sensing portion 80 is, as illustrated in FIGS. 9(*c*) and 9(*d*), equipped with the pressure sensing member 81 which is separate from the injector body (i.e., the lower body 11 and the valve body 17). FIG. 9(*d*) is a plan view of the pressure sensing member 81, as viewed from the orifice member 16. The pressure sensing member 81 is preferably made of a metallic plate (second member) extending substantially perpendicular to the axial direction of the fuel injector 2, i.e., the length of the control piston 30 and laid to overlap directly or indirectly with the orifice member 16 within the orifice member 16. The pressure sensing member 81 is secured firmly to the lower body 11 and the nozzle body 12. In this embodiment, the pressure sensing member 81 has the flat surface 82 placed in direct surface contact with the flat surface 162 of the orifice member 16 in the liquid-tight fashion. The pressure sensing member 81 and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81, respectively. The orifice member-far side of the sensing portion communication path 18*h* opens at a location corresponding to the fuel supply branch path 11*g* diverging from the fuel supply path 11*b*. The through hole 18*h* of the pressure sensing member 81 forms a portion of the path from the fuel supply path 11*b* to the pressure control chamber.

The pressure sensing member 81 is also equipped with a pressure sensing chamber 18*b* defined by a groove formed therein which has a given depth from the orifice member 16 side and inner diameter. The bottom of the groove defines a diaphragm 18*n*. The diaphragm 18*n* has a semiconductor sensing device 18*f* affixed or glued integrally to the surface thereof opposite the pressure sensing chamber 18*b*.

The diaphragm 18*n* is located at a depth that is at least greater than the thickness of the pressure sensor 18*f* below the surface of the pressure sensing member 81 which is opposite the pressure sensing chamber 18*b*. The surface of the diaphragm 18*n* to which the pressure sensor 18*f* is affixed is greater in diameter than the pressure sensing chamber 18*b*. The thickness of the diaphragm 18*n* is determined during the production thereof by controlling the depth of both of the grooves sandwiching the diaphragm 18*n*. The pressure sensing member 81 also has a groove 18*a* (a branch path below) formed in the flat surface 82 to have a depth smaller than the pressure sensing chamber 18*b*. The groove 18*a* communicates between the sensing portion communication path 18*h* and the pressure sensing chamber 18*b*. When the pressure sensing member 81 is placed in surface abutment with the orifice member 16, the groove 18*a* defines a combined path (a branch path below) whose wall is a portion of the flat surface of the orifice member 16. This establishes fluid communications of the groove 18*a* (i.e., the branch path) at a portion thereof with the inner orifice 16*b* that is the path extending from the fuel supply path 11*b* to the hydraulic pressure control chambers 8 and 16*c* and at another portion thereof with the diaphragm 18*n*, so that the diaphragm 18*n* may be deformed by the pressure of high-pressure fuel flowing into the pressure sensing chamber 18*b*.

The diaphragm 18*n* is the thinnest in wall thickness among the combined path formed between the groove 18*a* and the orifice member 16 and the pressure sensing chamber 18*b*. The thickness of the combined path is expressed by the thickness of the pressure sensing member 81 and the orifice member 16, as viewed from the inner wall of the combined path.

Instead of the groove 18*a*, a hole, as illustrated in FIG. 9(*e*), may be formed which extends diagonally between the sensing portion communication path 18*h* and the pressure sensing chamber 18*b*. The pressure sensor 18*f* (displacement sensing means) and the diaphragm 18*n* function as a pressure sensing portion.

The pressure sensing portion will be described below in detail with reference to FIG. 10.

The pressure sensor 18*f* is equipped with the circular diaphragm 18*n* formed in the pressure sensing chamber 18*b* and a single-crystal semiconductor chip 18*r* (which will be referred to as a semiconductor chip below) bonded as a displacement sensing means to the bottom of the recess 18*g* defining at one of surfaces thereof the surface of the diaphragm 18*n* and designed so that a pressure medium (i.e., gas or liquid) is introduced as a function of the fuel injection pressure in the engine into the other surface 18*q* side of the diaphragm 18*n* to sense the pressure based on the deformation of the diaphragm 18*n* and the semiconductor chip 18*r*.

The pressure sensing member 81 is formed by cutting and has the hollow cylindrical pressure sensing chamber 18*b* formed therein. The pressure sensing member 81 is made of Kovar that is Fi-Ni—Co alloy whose coefficient of thermal expansion is substantially equal to that of glass. The pressure sensing member 81 has formed therein the diaphragm 18*n* subjected at the surface 18*q* to the high-pressure fuel, as flowing into the pressure sensing chamber 18*b*.

As an example, the pressure sensing member 81 has the following measurements. The outer diameter of the cylinder is 6.5 mm. The inner diameter of the cylinder is 2.5 mm. The thickness of the diaphragm 18*n* required under 20 MPa is 0.65 mm, and under 200 MPa is 1.40 mm. The semiconductor chip 18*r* affixed to the surface of the diaphragm 18*n* is made of a monocrystal silicon flat substrate which has a plane direction of (100) and an uniform thickness. The semiconductor ship 18*r* has a surface 18*i* secured to the surface (i.e., the bottom surface of the recess 18*g*) through a glass layer 18*k* made from a low-melting glass material.

Taking an example, the semiconductor chip 18*r* is of a square shape of 3.56 mm×3.56 mm and has a thickness of 0.2 mm. The glass layer has a thickness of, for example, 0.06 mm. The semiconductor chip 18*r* is equipped with four rectangular gauges 18*m* (corresponding to strain sensors) installed in the surface 18*j* thereof. The gauges 18*m* is each implemented by a piezoresistor. The semiconductor chip 18*r* whose plane direction is (100) structurally has orthogonal crystal axes <110>.

The four gauges 18*m* are disposed two along each of the orthogonal crystal axes <110>. Two of the gauges 18*m* are so oriented as to have long side thereof extending in the x-direction, while the other two gauges 18*m* are so oriented as to have short sides extending in the y-direction. The four gauges 18*m* are arrayed along a circle whose center O lies at the center of the diaphragm 18*n*.

Although not shown in the drawings, the semiconductor chip 18*r* also has wires and pads which connect the gauges 18*m* together to make a typical bridge circuit and make terminals to be connected to an external device. The semiconductor chip 18*r* also has a protective film formed thereon. The semiconductor chip 18*r* is substantially manufactured in the following steps, as demonstrated in FIGS. 11(*a*) to 11(*c*). First, an n-type sub-wafer 19*a* is prepared. A given pattern is drawn on the sub-wafer 19*a* through the photolithography. Subsequently, boron is diffused over the sub-wafer 19*a* to form p+regions 19*b* that are piezoresistors working as the gauges 18*m*. Wires and pads 19*c* are formed on the sub-wafer 19*a*. An oxide film 19*d* is also formed over the surface of the sub-wafer 19*a* to secure electric insulation of the wires and the pads 19*c*. Finally, a protective film is also formed. The protective film on the pads is etched to complete the semiconductor chip 18*r*.

The semiconductor chip 18*r* thus produced is glued to the diaphragm 18*n* of the pressure sensing member 81 using a low-melting glass to complete the pressure sensor 18*f*, as illustrated in FIG. 10. The pressure sensor 18*f* converts the displacement (flexing) of the diaphragm 18*n* caused by the pressure of high-pressure fuel into an electric signal (i.e., a difference in potential of the bridge circuit arising from a change in resistance of the piezoresistors). An external processing circuit (not shown) handles the electric signal to determine the pressure.

The processing circuit may be fabricated monolithically on the semiconductor chip 18*r*. In this embodiment, a processing circuit board 18*d* is disposed over the semiconductor chip 18*r* and electrically connected therewith through, for example, the flip chip bonding. A constant current source and a comparator that are parts of the above described bridge circuit is fabricated on the processing circuit board 18*d*. A non-volatile memory (not shown) which stores data on the sensitivity of the pressure sensor 18*f* and the injection quantity characteristic of the fuel injector may also be mounted on the processing circuit board 18*d*. Wires 18*e* are connected at one end to terminal pads arrayed on the side of the processing circuit board 18*d* and at the other end to terminal pins 51*b* mounted in a connector 50 through a wire passage (not shown) formed within the valve body 17 and electrically connected to the ECU 107.

The pressure sensor 18*f* equipped with the piezoersistors and the low-melting glass work as a strain sensing device. The diaphragm 18*n* is installed at a depth from the surface of the pressure sensing member 81 which is opposite the pressure sensing chamber 18*b*. The depth is at least greater than the sum of the thicknesses of the pressure sensor 18*f* and the low-melting glass. In the case where which the processing circuit board 18*d* and the wires 18*e* are disposed on the semiconductor chip 18*r* in the thickness-wise direction thereof, the surface of the diaphragm 18*n* opposite the pressure sensing chamber 18*b* is located at a depth greater than a total thickness of the pressure sensor 18*f*, the processing circuit board 18*d*, and the wires 18*e*.

In this embodiment, the pressure sensor 18*f* of a semiconductor type affixed as the displacement sensing means to the metallic diaphragm 18*n* is used, but instead, strain gauges made of metallic films may be affixed to or vapor-deposited on the diaphragm 18*n*.

Referring back to FIG. 8, a coil 61 is wound directly around a resinous spool 62. The coil 61 and the spool 62 are covered at an outer periphery thereof with a resinous mold (not shown). The coil 61 and the spool 62 may be made by winding wire into the coil 61 using a winding machine, coating the outer periphery of the coil 61 with resin using molding techniques, and resin-molding the coil 61 and the spool 62. The coil 61 is connected electrically at ends thereof to the ECU 107 through terminal pins 51*a* formed in the connector 50 together with terminal pins 31*b*.

A stationary core 63 is substantially of a cylindrical shape. The stationary core 63 is made up of an inner peripheral core portion, an outer peripheral core portion, and an upper end connecting the inner and outer peripheral core portions together. The coil 61 is retained between the inner and outer peripheral core portions. The stationary core is made of a magnetic material.

The valve armature 42 is disposed beneath the lower portion of the stationary core 63, as viewed in FIG. 8, and faces the stationary core 63. Specifically, the valve armature 42 has an upper end surface serving as a pole face which is movable to or away from a lower end surface (i.e., a pole face) of the stationary core 63. When the coil 61 is energized, it will cause a magnetic flux to flow from pole faces of the inner and outer peripheral core portions of the stationary core 63 to the pole face of the valve armature 42 to create a magnetic attraction depending upon the magnetic flux density which acts on the valve armature 42.

A substantially cylindrical stopper 64 is disposed inside the stationary core 63 and held firmly between the stationary core 63 and an upper housing 53. An urging member 59 such as a compression spring is disposed in the stopper 64. The pressure, as produced by the urging member 59, acts on the valve armature 42 to bring the valve armature 42 away from the stationary core 63 so as to increase an air gap between the pole faces thereof. The stopper 64 has an armature-side end surface to limit the amount of lift of the valve armature 42 when lifted up.

The stopper 64 and the upper body 52 have formed therein a fuel path 37 from which the fuel flowing out of the valve chamber 17*c* and a through hole 17*b* is discharged to the low-pressure side.

The upper body 52 (i.e., an upper housing), an intermediate housing 54, and the valve body 17 (i.e., a lower housing) serve as a valve housing. The intermediate housing 54 is substantially cylindrical and retains the stationary core 63 therein so as to guide it. Specifically, the stationary core 63 is cylindrical in shape and has steps and a bottom. The stationary core 63 is disposed within an inner peripheral side of a lower portion of the intermediate housing 54. The outer periphery of the stationary core 63 decreases in diameter downward from the step thereof. The step engages the step formed on the inner periphery of the intermediate housing 54 to avoid the falling out of the intermediate housing 64 from the stationary core 63.

The valve armature 42 is made up of a substantially flat plate-shaped flat plate portion and a small-diameter shaft portion which is smaller in diameter then the flat plate portion. The upper end surface of the flat plate portion has the pole face opposed to the pole faces of the inner and outer peripheral core portions of the stationary core 63. The valve armature 42 is made of a magnetic material such as permendur. The plate portion has the small-diameter shaft portion formed on a lower portion side thereof.

The valve armature 42 has a substantially ball-shaped valve member 41 on the end surface 42*a* of the small-diameter shaft portion. The valve armature 42 is to be seated on the valve seat 16*d* of the orifice member 16 through the valve member 41. The orifice member 16 is positioned by and secured to the lower body 11 through the positioning member 92 such as a pin. The positioning member 92 is inserted into the hole 16*p* of the orifice member 16 and passes through the hole lap of the pressure sensing member 81.

The valve structures of the valve armature 42 to be seated on or away from the valve member 41 and the orifice member 16 equipped with the valve seat 16*d* will also be described below using FIG. 9.

The end surface 42*a* of the small-diameter shaft portion of the valve armature 42 is, as illustrated in FIG. 9, flat and placed to be movable into abutment with or away from a spherical portion 41*a* of the valve member 41. The small-diameter portion of the valve armature 42 is retained by the inner periphery of the through hole 17*a* of the valve body 17 to be slidable in the axial direction and to be insertable into the valve chamber 17*c*. The valve armature 42 is seated on or lifted up from the valve seat 16*d* through the valve member 41, thereby blocking or establishing the flow of fuel from the hydraulic pressure control chambers 8 and 16*c* to the valve chamber 17*c*.

Specifically, the valve member 41 is made of a spherical body with a flat face 41*b*. The flat face 41*b* is to be seated on or lifted away from the valve seat 16*b*. When the flat face 41*b* is seat on the valve seat 16, it closes the outer orifice 16*a*. The flat face 41*b* forms the second flat surface.

The orifice member 16 has a bottomed guide hole 16*g* formed in the valve armature-side end surface 16*l* to guide slidable movement of the spherical portion 41*a* of the valve member 41. The valve seat 16*d* is so formed on the bottom of the inner periphery of the guide hole 16*g* as to have flat seat surface. The valve seat 16*d* constitutes a seat portion. The guide hole 16*g* constitutes a guide portion. The valve seat 16*d* defines a step portion formed in the orifice member 16. The end of an opening of the guide hole 16*b* lies flush with the end surface 161 of the orifice member 16.

The outer periphery of the valve seat 16*d* is smaller in size than the inner periphery of the guide hole 16*g*. An annular fuel release path 16*e* is formed between the valve seat 16*d* and the guide hole 16*g*. The outer circumference of the valve seat 16*d* is smaller than that of the flat face 41*b* of the valve member 41, so that when the flat face 41*d* is seated on or away from the valve seat 16*d*, a portion of the bottom of the guide hole 16*g* other than the valve seat 16*d* on which the flat face 41*b* is to be seated does not limit the flow of the fuel.

The fuel release path 16*e* defines a fluid release path in an area where the valve seat is in close contact with the second flat surface.

The fuel release path 16*e* is so shaped as to increase in sectional area thereof from the valve seat 16*d* side to the guide hole 16*g* side, thereby achieving a smooth flow of the fuel, as emerging from the valve seat 16*d* when the valve member 41 is lifted away from the valve seat 16*d*, to the low-pressure side.

The valve member 41 is, as described above, retained by the guide hole 16*g* to be slidable in the axial direction. The size of a clearance between the inner periphery of the guide hole 16*g* and the spherical portion 41*a* of the valve member 41 is, therefore, selected as a guide clearance which permits the sliding motion of the valve member 41. The amount of fuel leaking from the guide clearance is insufficient as the flow rate of fuel flowing from the valve seat 16*d* to the low-pressure side.

In this embodiment, the guide hole 16*g* has formed in the inner peripheral wall thereof fuel leakage grooves 16*r* leading to the valve chamber 17*c* on the low-pressure side. The fuel leakage grooves 16*r* serve to increase a sectional area of a flow path through which the fuel flows from the valve seat 16*d* to the low-pressure side. Specifically, the fuel leakage grooves 16*r* are formed in the inner wall of the guide hole 16*g* to increase the sectional area of the flow path through which the fuel flows from the valve seat 16*d* to the low-pressure side, thereby ensuring the flow rate of fuel to flow into the communication paths 16*a*, 16*b*, and 16*c* without decreasing the flow rate of fuel flowing from the valve seat 16*d* to the low-pressure side when the valve member 41 is lifted away from the valve seat 16*d*.

The fuel leakage grooves 16*r* are so formed in the inner wall of the guide hole 16*g* as to extend radially from the valve seat 16*d* (which is not shown), thereby permitting the plurality (six in this embodiment) of the leakage grooves 16*r* to be provided depending upon the flow rate of fuel to flow out of the communication paths 16*a*, 16*b*, and 16*c*. The radial extension of the leakage grooves 16*r* avoids the instability of orientation of the valve member 41 arising from fluid pressure of the fuel flowing from the valve seat 16*d* to the fuel leakage grooves 16*r*.

The inner periphery of the valve seat 16*d* has the step. The outlet side inner periphery 16*l*, the outer orifice 16*a*, and the pressure control chamber 16*c* are formed in that order.

The valve armature 42 constitutes a supporting member. The orifice member 16 constitutes the valve body with the valve seat. The valve body 17 constitutes the valve housing.

The operation of the fuel injector 2 having the above structure will be described below. The high-pressure fuel is supplied from the common rail 104 as a high-pressure source to the fuel sump 12*c* through the high-pressure fuel pipe, the fuel supply path 11*b*, and the fuel feeding path 12*d*. The high-pressure fuel is also supplied to the hydraulic pressure control chambers 8 and 16*c* through the fuel supply path 11*b* and the inner orifice 16*b*.

When the coil 61 is in a deenergized state, the valve armature 42 and the valve member 41 are urged by the urging member 59 into abutment with the valve seat 16*d* (downward in FIG. 8), so that the valve member 41 is seated on the valve seat 16*d*. This closes the outer orifice 16*a* to block the flow of fuel from the hydraulic pressure control chambers 8 and 16*c* to the valve chamber 17*c* and the low pressure path 17*d*.

The pressure of fuel in the hydraulic pressure control chambers 8 and 16*c* (i.e., the back pressure) is kept at the same level as in the common rail 104. The sum of the operating force (which will also be referred to as a first operating force below) that is the back pressure, as accumulated in the hydraulic pressure control chambers 8 and 16*c*, urging the nozzle needle 20 through the control piston 30 in the spray hole-closing direction and the operating force (which will also be referred to as a second operating force below), as produced by the spring 35, urging the nozzle needle 20 in the spray hole-closing direction is, thus, kept greater than the operating force (which will also be referred to as a third operating force below), as produced by the common rail pressure in the fuel sump 12*c* and around the valve seat 12*a*, urging the nozzle needle 20 in the spray hole-opening direction. This causes the nozzle needle 20 to be placed on the valve seat 12*a* and closes the spray hole 12*b* not to produce a jet of fuel from the spray holes 12*b*. The pressure of fuel (back pressure) in the closed outer orifice 16*a* (i.e., an outlet side inner periphery 16*l*) is exerted on the valve member 41 seated on the valve seat 16*d*.

When the coil 61 is energized (i.e., when the fuel injector 2 is opened), it will cause the coil 61 to produce a magnetic force so that a magnetic attraction is created between the pole faces of the stationary core 63 and the valve armature 42, thereby attracting the valve armature 42 toward the stationary core 63. The operating force (which will also be referred to as a fourth operating force below), as produced by the back pressure in the outer orifice 16*a* is exerted on the valve member 41 to lift the valve member 41 away from the valve seat 16*d*. The valve member 41 is lifted away from the valve seat 16*d* along with the valve armature 42, thus causing the valve member 41 to move along the guide hole 16*g* toward the stationary core 63.

When the valve member 41 is lifted away from the valve seat 16*d* along with the valve armature 42, it creates the flow of fuel from the hydraulic pressure control chambers 8 and 16*c* to the valve chamber 17*c* and to the low-pressure path 17*d* through the outer orifice 16*a*, so that the fuel in the hydraulic pressure control chambers 8 and 16*c* is released to the low-pressure side. This causes the back pressure, as produced by the hydraulic pressure control chambers 8 and 16*c*, to drop, so that the first operating force decreases gradually. When the third operating force urging the nozzle needle in the spray hole-opening direction exceeds the sum of the first and second operating forces urging the nozzle needle 20 in the spray hole-closing direction, it will cause the nozzle needle 20 to be lifted up from the valve seat 12*a* (i.e., upward, as viewed in FIG. 8) to open the spray hole 12*b*, so that the fuel is sprayed from the spray hole 12*b*.

When the coil 61 is deenergized (i.e., when the injector 2 is closed), it will cause the magnetic force to disappear from the coil 61, so that the valve armature 42 and the valve member 41 are pushed by the urging member 59 to the valve seat 16*d*. When the flat face 41*b* of the valve member 41 is seated on the valve seat 16*d*, it blocks the flow of fuel from the hydraulic pressure control chambers 8 and 16*c* to the valve chamber 17*c* and the low-pressure path 17*d*. This results in a rise in the back pressure in the hydraulic pressure control chambers 8 and 16*c*. When the first and second operating forces exceeds the third operating force, it will cause the nozzle needle 20 to start to move downward, as viewed in FIG. 8. When the nozzle needle 20 is seated on the valve seat 12*a*, it terminates the fuel spraying.

The above described structure of the embodiment enables the pressure sensing portion to be disposed inside itself and possesses the following advantages.

The diaphragm 18*n* made by the thin wall is disposed in the branch path which diverges from the fuel supply path 11*b*. This facilitates the ease of formation of the diaphragm 18*n* as compared with when the diaphragm 18*n* is made directly in a portion of an outer wall of the fuel injector near the fuel flow path, thus resulting the ease of controlling the thickness of the diaphragm 18*n* to avoid a variation in the thickness and increase in accuracy in measuring the pressure of fuel in the fuel.

The diaphragm 18*n* is made by a thinnest portion of the branch path, thus resulting in an increase in deformation thereof arising from a change in pressure of the fuel.

The pressure sensing member 81 which is formed to be separate from the injector body (i.e., the lower body 11 and the valve body 17) has the diaphragm 18*n*, the hole, or the groove, thus facilitating the ease of machining the diaphragm 18*n*. This also results in ease of controlling the thickness of the diaphragm 18*n* to improve the accuracy in measuring the pressure of fuel.

The pressure sensing member 81 including the diaphragm 18*n* is stacked on the orifice member 16 constituting the part of the pressure control chambers 8*c* and 16*c*, thereby avoiding an increase in diameter or radial size of the injector body.

The pressure sensing member 81 is made of a plate extending perpendicular to the axial direction of the injector body, thus avoiding an increase in dimension in the radial direction or thickness-wise direction of the injector body when the pressure sensing portion is installed inside the injector body.

The branch path diverges from the path extending from the fuel supply path 11*b* to the pressure control chambers 8 and 16*c*, thus eliminating the need for a special tributary for connecting the branch path to the fuel supply path 11*b*, which avoids an increase in dimension in the radial direction or thickness-wise direction of the injector body when the pressure sensing portion is installed inside the injector body.

The diaphragm 18*n* is located at a depth that is at least greater than the thickness of the strain sensing device below the surface of the pressure sensing member 81, thereby avoiding the exertion of the stress on the strain sensing device when the pressure sensing member 81 is assembled in the injector body, which enables the pressure sensing portion to be disposed in the injector body.

The injector body has formed therein the wire path, thus facilitating ease of layout of the wires. The connector 50 has installed therein the terminal pins 51*a* into which the signal to the coil 61 of the solenoid-operated valve device 7 (actuator) is inputted and the terminal pin 51*b* from which the signal from the pressure sensor 18*f* (displacement sensing means) is outputted, thus permitting steps for connecting with the external to be performed simultaneously.

In this embodiment, the sensing portion communication path 18*h* corresponds to the high-pressure fuel path. The pressure sensing member 81 defining the high-pressure fuel path corresponds to the path member. The diaphragm 18*n* formed in the pressure sensing member 81 corresponds to the thin-walled portion.

Sixth Embodiment

Figure 12:
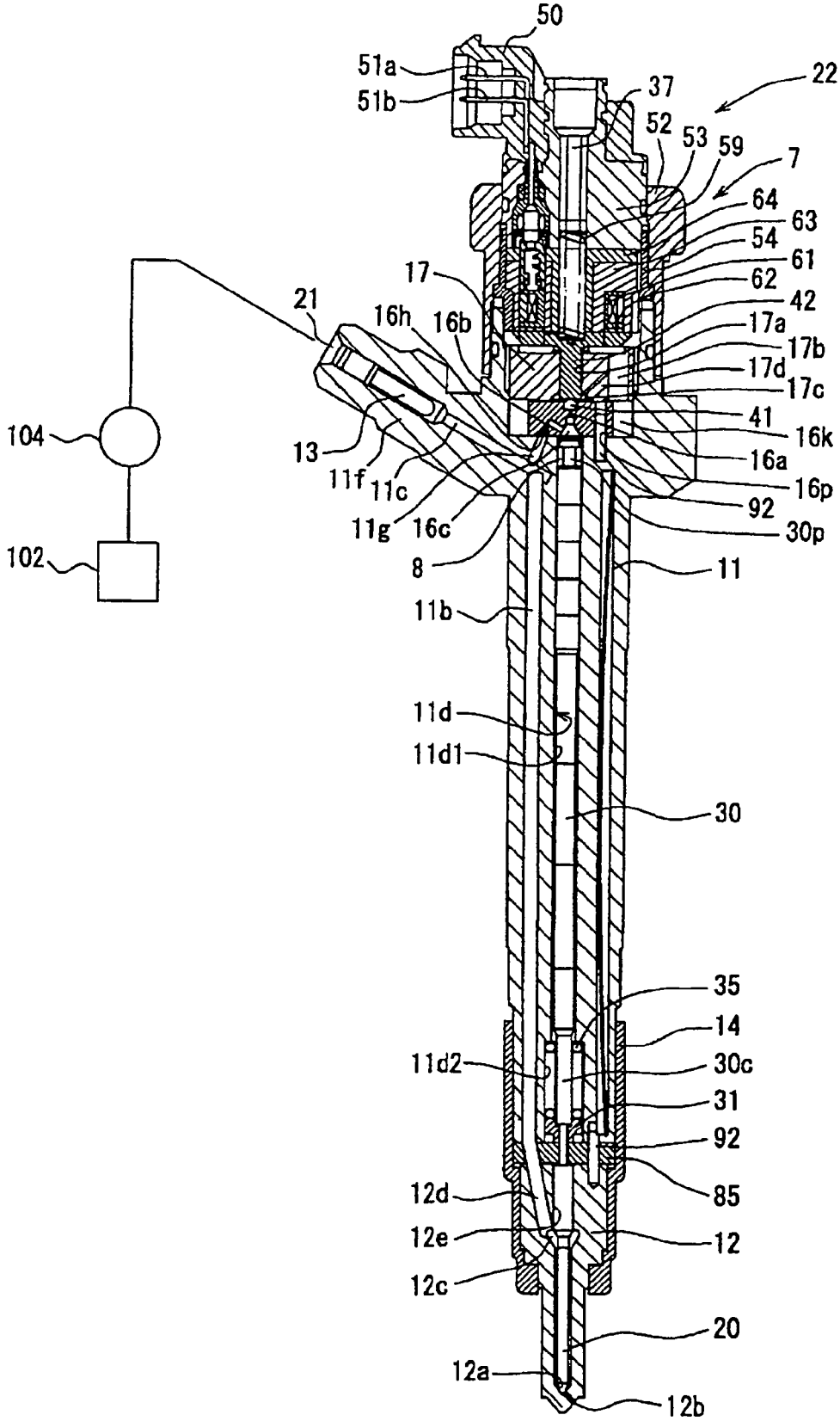
FIG. 12 is a sectional view of an injector for a fuel injection device according to the sixth embodiment.
Figure 13:
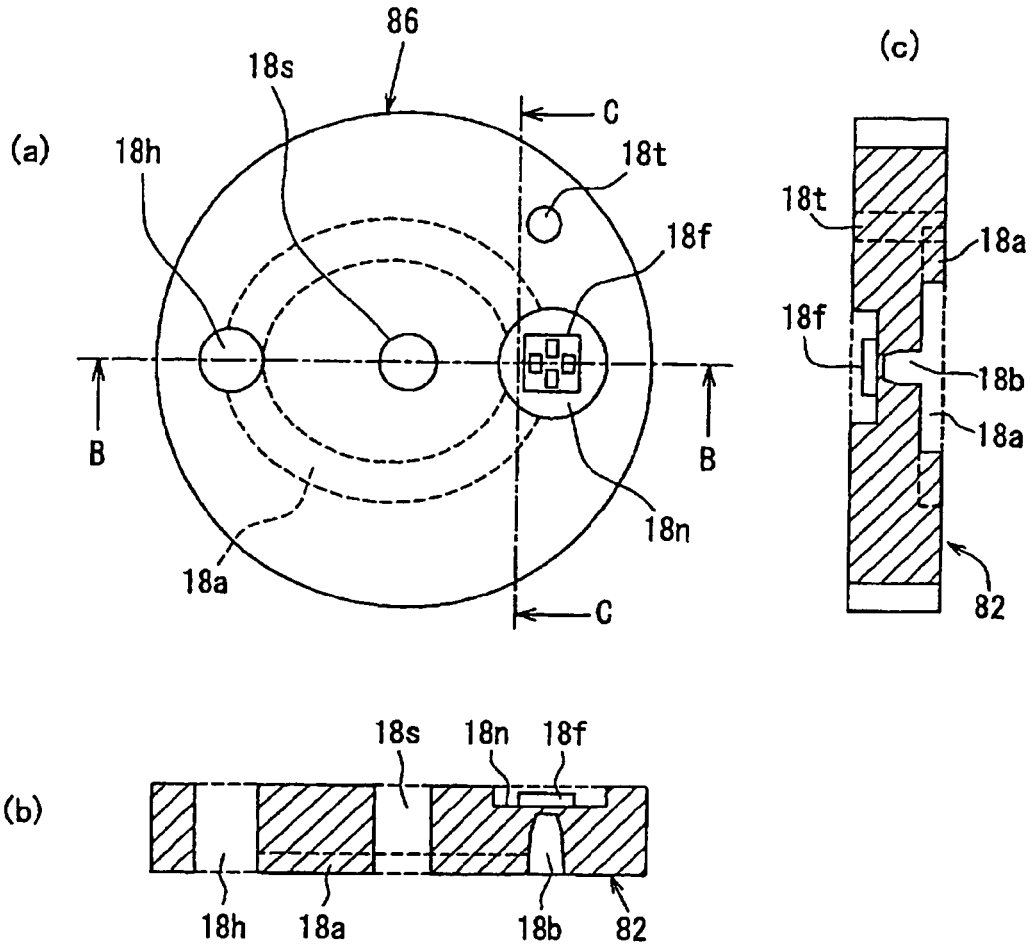
FIG. 13(*a*) is a plan view of a pressure sensing member of the sixth embodiment.

FIG. 12 is a sectional view which shows an injector 22 according to the sixth embodiment of the invention. FIGS. 13(*a*) to 13(*c*) are partial sectional and plane views which illustrate highlights of the pressure sensing member. The fuel injection device of this embodiment will be described below with reference to the drawings. The same reference numbers are attached to the same or similar parts as in the fifth embodiment, and explanation thereof in detail will be omitted here.

The sixth embodiment is equipped with the pressure sensing portion 85 instead of the pressure sensing portion 80 used in the fifth embodiment.

The injector 22, as can be seen in FIG. 12, includes the nozzle body 12 in which the nozzle needle 20 is disposed to be moveable in the axial direction, the lower body 11 in which the spring 35 working as an urging member to urge the nozzle needle 20 in the valve-closing direction, the pressure sensing portion 85 nipped between the nozzle body 12 and the lower body 11, the retaining nut 14 working as a fastening member to fasten the nozzle body 12 and the pressure sensing portion 85 together with a given degree of fastening force, and the solenoid-operated valve device 7 working as a fluid control valve.

The inlet 16*h* of the orifice member 16 is disposed at a location which establishes communication between the pressure control chamber 16*c* and the fuel supply branch path 11*g* diverging from the fuel supply path 11*b*. The pressure control chambers 8*c* and 16*c* of the orifice member 16 constitute a pressure control chamber.

The pressure sensor 85, as illustrated in FIGS. 13(*a*) to 13(*c*), preferably includes a pressure sensing member 86 (corresponding to the path member) made of a metallic disc plate (i.e., a second plate member) which extends substantially perpendicular to the axial direction of the fuel injector 2, i.e., the length of the control piston 30 (and the nozzle needle 20) and is nipped between the nozzle body 12 and the lower body 11. In this embodiment, the pressure sensing member 86 has an even or flat surface 82 placed in direct abutment with a flat surface of the nozzle body 12 in a liquid-tight fashion. The pressure sensing member 86 is substantially of a circular shape which is identical in contour with the nozzle body 12 side end surface of the lower body 11. The pressure sensing member 86 is so designed that the fuel supply path 11*b* of the lower body 11, the tip of the needle 30*c* of the control piston 30, and a inserted portion of a positioning pin 92*b* coincide with a sensing portion communication path 18*h*, a through hole 18*s*, and a positioning through hole 18*t*. The sensing portion communication path 18*h* communicates at a lower body-far side thereof with the fuel feeding path 12*d* in the nozzle body 12. The sensing portion communication path 18*h* of the pressure sensing portion 86 forms a portion of a path extending from the fuel supply path 11*b* to the fuel feeding path 12*d*.

The pressure sensing member 86 has a pressure sensing chamber 18*b* defined by a groove which has a given depth from the nozzle body 12-side and an inner diameter. The bottom of the groove defines the diaphragm 18*n*. A semiconductor pressure sensor 18*f*, as described in FIGS. 10 and 11, is attached to the surface of the diaphragm 18*n*. The diaphragm 18*n* is located at a depth that is at least greater than the thickness of the pressure sensing device 18*b* below the surface of the pressure sensing member 86 which is opposite the surface in which the pressure sensing chamber 18 is formed. The surface to which the pressure sensing device 18*f* is affixed is greater in area or diameter than the pressure sensing chamber 18*b*. The thickness of the diaphragm 18*n* is controlled by controlling depths of both the grooves located on both sides of the diaphragm 18*n* during the production process. The pressure sensing member 86 also has grooves 18*a* (branch paths below) formed in the flat surface 82 to have a depth smaller than the pressure sensing chamber 18*b*. The grooves 18*a* communicate between the sensing portion communication path 18*h* and the pressure sensing chamber 18*b*. In this embodiment, the grooves 18*a* (preferably, two grooves 18*a*) are formed on right and left sides of a portion into which the top of the needle 30*c* of the control piston 30 is inserted, thereby ensuring the efficiency in feeding the fuel from the fuel supply path 11*b* to the pressure sensing chamber 18*b*.

Like in the fifth embodiment, the pressure sensor 18*f* including the piezoresistors and a low-melting point glass constitutes a strain sensing device. The diaphragm 18*n* is located below the surface of the pressure sensing member 86 which is opposite the pressure sensing chamber 18*b* at a depth that is at least greater than the sum of thicknesses of the pressure sensing device 18*f* and the low-melting glass. In the case where the processing substrate 18*d* and the wires 18*e* are disposed in the thickness-wise direction, the pressure sensing chamber 18*b*-opposite surface of the diaphragm 18*n* is located at a depth greater than a total thickness of the pressure sensing device 18*f*, the low-melting glass, the processing substrate 18*d*, and the wires 18*e*.

This embodiment has the same advantages as in the fifth embodiment. Particularly, the sixth embodiment offers the following additional advantages.

The diaphragm 18*n* and the holes or the grooves 18*a* are provided in the pressure sensing member 86 which is separate from the injector body, thus facilitating the ease of formation of the diaphragm 18*n*. This results in the ease of controlling the thickness of the diaphragm 18*n* and improvement in measuring the pressure of fuel. The pressure sensing member 86 is stacked between the lower body 11 and the nozzle body 12, thus avoiding an increase in dimension of the injector body in the radius direction thereof. It is possible to measure the pressure of high-pressure fuel near the nozzle body 12, thus resulting in a decrease in time lag in measuring a change in pressure of fuel sprayed actually.

The branch path is provided in, the metallic pressure sensing member 86 stacked between the lower body 11 and the nozzle body 12, thus eliminating the need for a special tributary for connecting the branch path to the fuel supply path 11*b* and the fuel feeding path 12*d*, which avoids an increase in dimension in the radial direction or thickness-wise direction of the injector body when the pressure sensing portion 85 is installed inside the injector body.

The diaphragm 18*n* is located at a depth that is at least greater than the thickness of the strain sensing device below the surface of the pressure sensing member 86, thereby avoiding the exertion of the stress on the strain sensing device when the pressure sensing member 86 is assembled in the injector body, which facilitates the installation of the pressure sensing portion in the injector body.

In this embodiment, the sensing portion communication path 18*h* corresponds to the high-pressure fuel path. The pressure sensing member 86 defining the high-pressure fuel path corresponds to the path member. The diaphragm 18*n* formed in the pressure sensing member 86 corresponds to the thin-walled portion.

Seventh Embodiment

Figure 14:
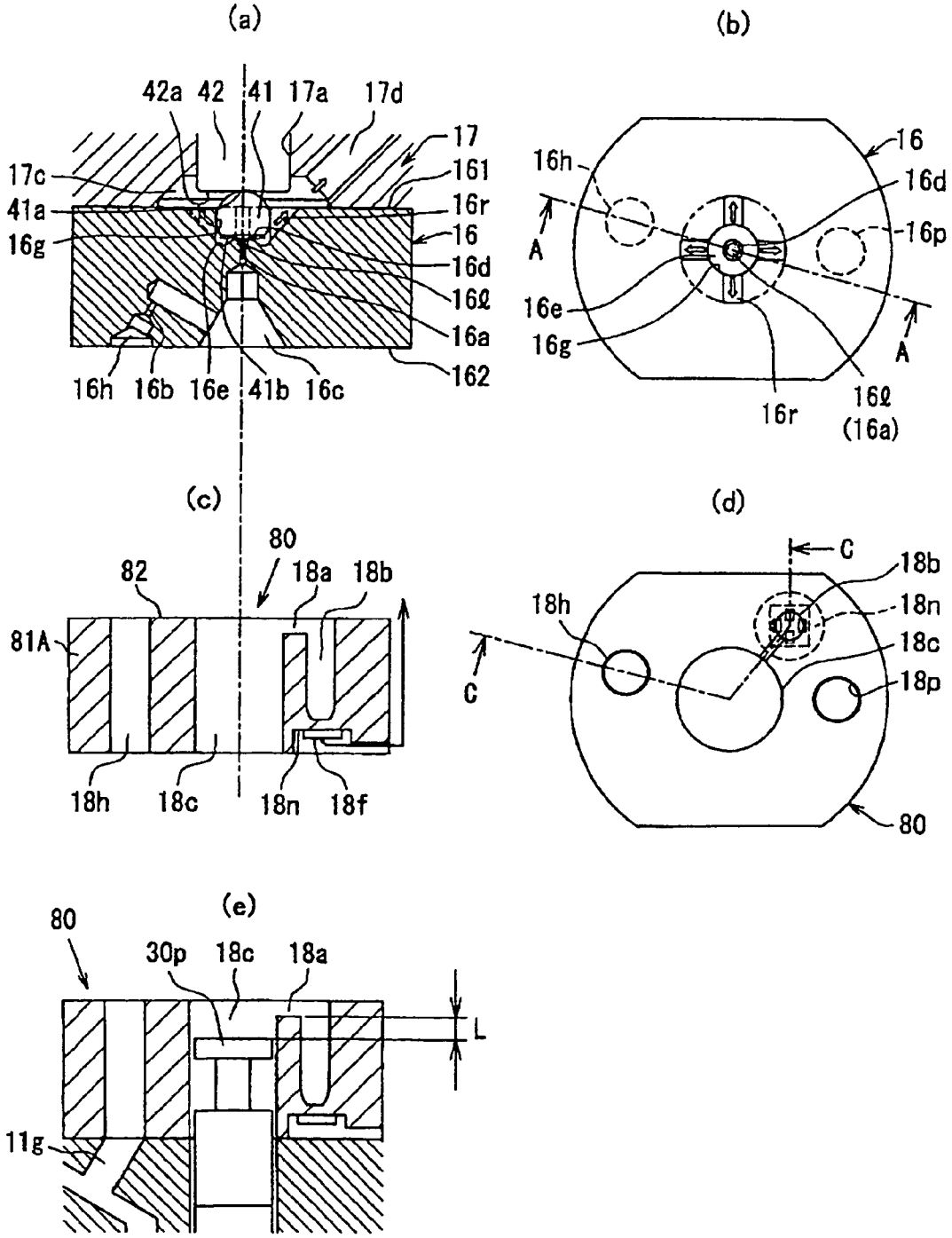
FIG. 14(*a*) is a partial sectional view which shows highlights of an orifice member according to the seventh embodiment.

The seventh embodiment of the invention will be described below. FIGS. 14(*a*) and 14(*b*) are a partial sectional view and a plane view which show highlights of a fluid control valve of this embodiment. FIGS. 14(*c*) and 14(*d*) are a partial sectional view and a plane view which show highlights of a pressure sensing member. FIG. 14(*e*) a sectional view which shows a positional relation between a control piston and the pressure sensing member when being installed in an injector body. The same reference numbers are attached to the same or similar parts to those in the fifth to sixth embodiments, and explanation thereof in detail will be omitted here.

In the seventh embodiment, instead of the pressure sensing member 81 used in the fifth embodiment, the pressure sensing member 81A (corresponding to the path member), as illustrated in FIGS. 14(*c*) and 14(*d*), is used. Other arrangements, functions, and beneficial effects including the orifice member 16 of this embodiment, as illustrated in FIGS. 14(*a*) and 14(*b*), are the same as those in the sixth embodiment.

The pressure sensing member 81A of this embodiment is, as shown in FIGS. 14(*c*) and 14(*d*), made of the pressure sensing member 81A which is separate from the injector body (i.e., the lower body 11 and the valve body 17). The pressure sensing member 81A is preferably made by a metallic plate (second member) disposed substantially perpendicular to the axial direction of the injector 2, that is, the length of the control piston 30 and stacked directly or indirectly on the orifice member 16 in the lower body 11 to be retained integrally with the lower body 11 and the nozzle body 12.

In this embodiment, the pressure sensing member 81A has the flat surface 82 placed in direct surface contact with the flat surface 162 of the orifice member 16 in the liquid-tight fashion. The pressure sensing member 81A and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81, respectively. The orifice member-far side of the sensing portion communication path 18*h* opens at a location corresponding to the fuel supply branch path 11*g* diverging from the fuel supply path 11*b*. The through hole 18*h* of the pressure sensing member 81 forms a portion of the path from the fuel supply path 11*b* to the pressure control chambers 16*c* and 18*c*.

The pressure sensing member 81A is also equipped with the pressure sensing chamber 18*b* defined by a groove formed therein which has a given depth from the orifice member 16 side and inner diameter. The bottom of the groove defines the diaphragm 18*n*. The diaphragm 18*n* has the semiconductor sensing device 18*f*, as illustrated in FIG. 10, affixed or glued integrally to the surface thereof opposite the pressure sensing chamber 18*b*.

The diaphragm 18*n* is located at a depth that is at least greater than the thickness of the pressure sensor 18*f* below the surface of the pressure sensing member 81 which is opposite the pressure sensing chamber 18*b*. The surface of the diaphragm 18*n* to which the pressure sensor 18*f* is affixed is greater in diameter than the pressure sensing chamber 18*b*. The thickness of the diaphragm 18*n* is determined during the production thereof by controlling the depth of both grooves sandwiching the diaphragm 18*n*. The pressure sensing member 81 also has the groove 18*a* (a branch path below) formed in the flat surface 82 to have a depth smaller than the pressure sensing chamber 18*b*. The groove 18*a* communicates between the sensing portion communication path 18*h* and the pressure sensing chamber 18*b*. When the pressure sensing member 81A is placed in surface abutment with the orifice member 16, the groove 18*a* defines a combined path (a branch path below) whose wall is a portion of the flat surface of the orifice member 16. This establishes fluid communications of the groove 18*a* (i.e., the branch path) at a portion thereof with the pressure control chambers 16*c* and 18*c* at a location away from the through hole 18*h* and at another portion thereof with the diaphragm 18*n*, so that the diaphragm 18*n* may be deformed by the pressure of high-pressure fuel flowing into the pressure sensing chamber 18*b*.

The diaphragm 18*n* is the thinnest in wall thickness among the combined path formed between the groove 18*a* and the orifice member 16 and the pressure sensing chamber 18*b*. The thickness of the combined path is expressed by the thickness of the pressure sensing member 81 and the orifice member 16, as viewed from the inner wall of the combined path.

As illustrated in FIG. 14(*e*), the outer end wall (i.e., an upper end) 30*p* of the control piston 30, the orifice member 16, and the pressure sensing member 81A define the pressure control chambers 16*c* and 18*c*. The outer end wall 30P is so disposed that it lies flush with the lower end of the groove 18*a* or is located at a distance L away from the lower end of the groove 18*a* toward the spray hole 12*b* when the spray hole 12*b* is opened. Specifically, when the spray hole 12*b* is opened (i.e., the control piston 30 is lifted up toward the valve member 41), the outer end wall 30*p* is disposed inside the pressure control chamber 18*c* of the pressure sensing member 81A.

In the case where the outer end wall 30*p* of the control piston 30 is located farther from the spray hole 12*b* than the groove 18*a* when the spray hole 12*b* is opened, the control piston 30 may cover the groove 18*a*. In such an event, it is possible for the pressure sensor to measure a change in pressure in the pressure control chambers 16*c* and 18*c* only after the pressure in the pressure control chambers 16*c* and 18*c* rises to move the control piston 30 in the valve-closing direction, and the groove 18*a* is opened. This results in a loss of time required to measure the pressure. However, in this embodiment, the outer end wall 30*p* is located, as described above, so that the branch path is placed in communication with the pressure control chamber at all the time when the spray hole 12*b* is opened. Needless to say, the control piston 30 is returned back toward the spray hole side upon the valve opening, the outer end wall 30*p* will be located closer to the spray hole 12*b* than the groove 18*a* by the distance L plus the amount of lift. It is advisable that the outer end wall 30*p* be disposed inside the pressure control chamber 18*c* of the pressure sensing member 81A upon the valve closing for avoiding the catch of the outer end wall 30*p* near a contact surface between the pressure sensing member 81A and the pressure control chamber 18*c* when passing it.

In the above embodiment, the chamber 16*c* formed inside the orifice member 16 and the chamber 18*c* formed inside the pressure sensing member 81A define the pressure control chambers 16*c* and 18*c*. In operation, a portion of the high-pressure fuel is supplied to and accumulated in the pressure control chambers 16*c* and 18*c*, thereby producing force in the pressure control chambers 16*c* and 18*c* which urges the nozzle needle 20 in the valve-closing direction to close the spray hole 12*b*. This stops the spraying of the fuel. When the high-pressure fuel, as accumulated in the pressure control chambers 16*c* and 18*c*, is discharged so that the pressure therein drops, the nozzle needle is opened, thereby initiating the spraying of the fuel from the spray hole. Therefore, the time the internal pressure in the pressure control chambers 16*c* and 18*e* changes coincides with that the fuel is sprayed form the spray hole.

Accordingly, in this embodiment, the diaphragm 18*n* is connected indirectly to the pressure control chambers 16*c* and 18*c* through the groove 18*a* to achieve the measurement of a change in displacement of the diaphragm 18*n* using the pressure sensor 18*f* (i.e., displacement sensing means), thereby ensuring the accuracy in measuring the time when the fuel is sprayed actually from the spray hole 12*b*. For instance, the quantity of fuel having been sprayed actually from each injector in the common rail system may be known by calculating a change in pressure of the high-pressure fuel in the injector body and the time of such a pressure change. In this embodiment, a change in pressure in the pressure control chambers 16*c* and 18*c* is measured, thus ensuring the accuracy in measuring the time of the pressure change as well as the degree of the pressure change itself (i.e., an absolute value of the pressure or the amount of the change in pressure) with less time lag.

The pressure sensing body 81A may be, like in the fifth embodiment, made of Kovar that is an Fi-Ni—Co alloy, but is made of a metallic glass material in this embodiment. The metallic glass material is a vitrified amorphous metallic material which has no crystal structure and is low in Young's modulus and thus is useful in improving the sensitivity of measuring the pressure. For instance, a Fe-based metallic glass such as {Fe (Al, Ga)—(P, C, B, Si, Ge)}, an Ni-based metallic glass such as {Ni—(Zr, Hf, Nb)—B}, a Ti-based metallic glass such as {Ti—Zr—Ni—Cu}, or a Zr-based metallic glass such as Zr—Al-TM (TM: VI~VIII group transition metal).

The orifice member 6 is preferably made of a high-hardness material because the high-pressure fuel flows therethrough at high speeds while hitting the valve ball 41 many times. Specifically, the material of the orifice member 16 is preferably higher in hardness than that of the pressure sensing member 81A.

In this embodiment, the groove 18*a* is formed at a location in the inner wall of the pressure control chambers 16*c* and 18*c* which is different (i.e., away) from that of the inner orifice 16*b* and the outer orifice 16*a*. In other words, the groove 18*a* is formed on the pressure sensing member 81A side away from a high-pressure fuel flow path extending from the inner orifice 16*b* to the outer orifice 16*a*. The flow of the high-pressure fuel within the inner orifice 16*b* and the outer orifice 16*a* or near openings thereof is high in speed, thus resulting in a time lag until a change in pressure is in the steady state.

Instead of the groove 18*a* of FIG. 14(*c*), a hole (not shown), like in the modification illustrated in FIG. 9(*e*), may be formed which is so inclined as to extend from the pressure control chamber 18*c* of the pressure sensing member 81A to the pressure sensing chamber 18*b*.

The above structure of the embodiment enables the pressure sensing portion to be disposed inside the injector and posses the following beneficial effects, like in the fifth embodiment.

The diaphragm 18*n* made of a thin wail is provided in the branch path diverging from the fuel supply path 11*b*, thus facilitating the ease of formation of the diaphragm 18*n* as compared with when the diaphragm 18*n* is made directly in any portion of an injector outer wall near a fuel flow path extending therein. This results in ease of controlling the thickness of the diaphragm 18*n* and an increase in accuracy in measuring the pressure.

The diaphragm 18*n* is made by a thinnest portion of the branch path, thus resulting in an increase in deformation thereof arising from a change in the pressure.

The pressure sensing body 81A which is separate from the injector body (i.e., the lower body 11 and the valve body 17) has the diaphragms 18*n*, the holes, or the groove, thus facilitating the ease of machining the diaphragm 18*n*. This results in ease of controlling the thickness of the diaphragm 18*n* to improve the accuracy in measuring the pressure of fuel.

The pressure sensing member 81A including the diaphragm 18*n* is stacked on the orifice member 16 constituting the part of the pressure control chambers 8*c* and 16*c*, thereby avoiding an increase in diameter or radial size of the injector body.

The pressure sensing member 81A is made of a plate extending perpendicular to the axial direction of the injector body, thus avoiding an increase in dimension in the radial direction or thickness-wise direction of the injector body when the pressure sensing portion is installed inside the injector body.

The branch path diverges from the path extending from the fuel supply path 11*b* to the pressure control chambers 16*c* and 18*c*, thus eliminating the need for a special tributary for connecting the branch path to the fuel supply path 11*b*, which avoids an increase in dimension in the radial direction or thickness-wise direction of the injector body when the pressure sensing portion is installed inside the injector body.

The diaphragm 18*n* is located at a depth that is at least greater than the thickness of the strain sensing device below the surface of the pressure sensing member 81A, thereby avoiding the exertion of the stress on the strain sensing device when the pressure sensing member 81A is assembled in the injector body, which enables the pressure sensing portion to be disposed in the injector body.

The injector body has formed therein the wire path, thus facilitating ease of layout of the wires. The connector 50 has installed therein the terminal pins 51*a* into which the signal to the coil 61 of the solenoid-operated valve device 7 (actuator) is inputted and the terminal pin 51*b* from which the signal from the pressure sensor 18*f* (displacement sensing means) is outputted, thus permitting steps for connecting with the external to be performed simultaneously.

In this embodiment, the sensing portion communication path 18*h* corresponds to the high-pressure fuel path. The pressure sensing member 86A defining the high-pressure fuel path corresponds to the path member. The diaphragm 18*n* formed in the pressure sensing member 86A corresponds to the thin-walled portion.

Eighth Embodiment

Figure 15:
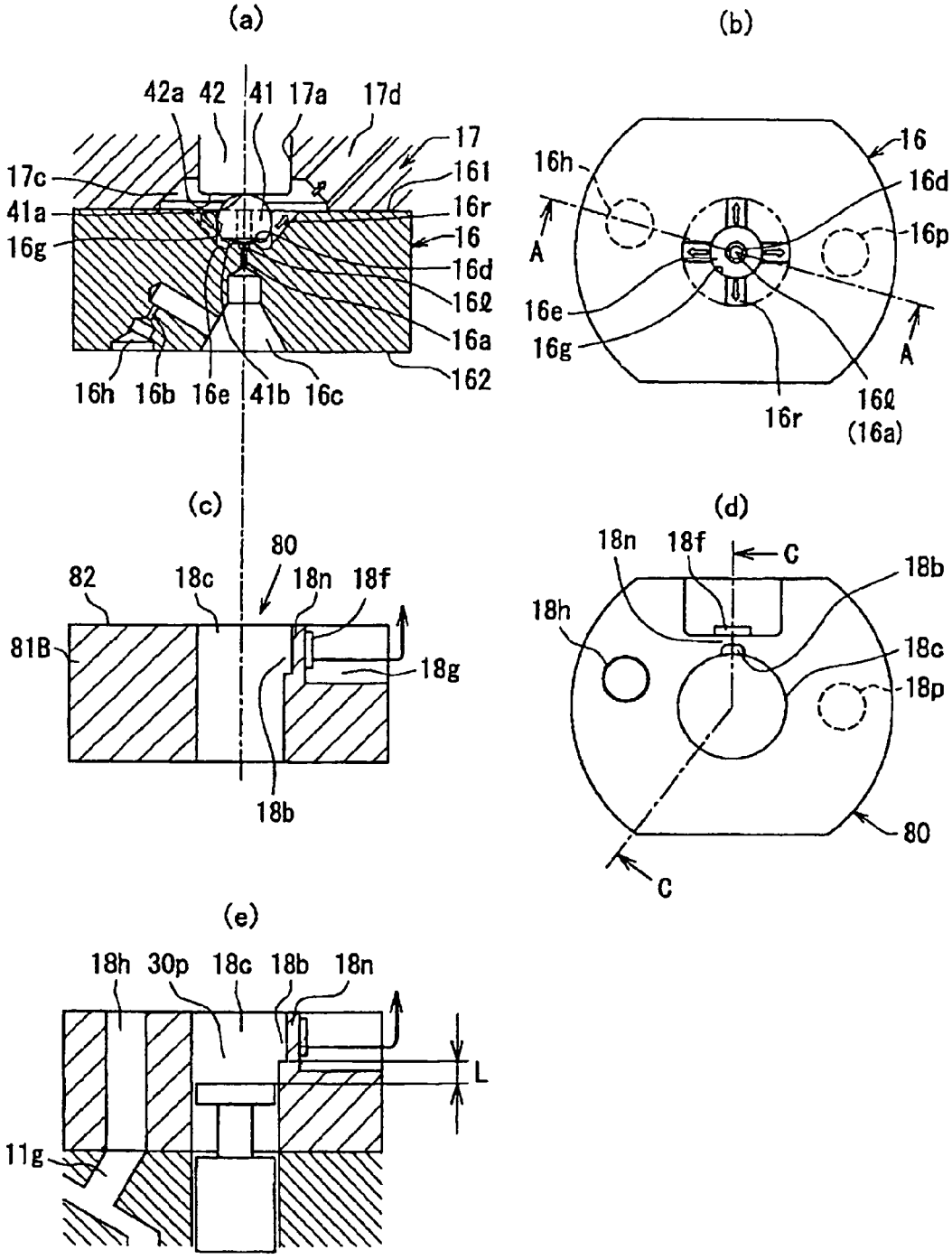
FIG. 15(*a*) a partial sectional view which shows highlights of an orifice member according to the eighth embodiment.

The eighth embodiment of the invention will be described below. FIGS. 15(*a*) and 15(*b*) are a partial sectional view and a plane view which show highlights of a fluid control valve of this embodiment. FIGS. 15(*c*) and 15(*d*) are a partial sectional view and a plane view which show highlights of a pressure sensing member. FIG. 15(*e*) a sectional view which shows a positional relation between a control piston and the pressure sensing member when being installed in an injector body. The same reference numbers are attached to the same or similar parts to those in the fifth to seventh embodiments, and explanation thereof in detail will be omitted here.

In the eighth embodiment, instead of the pressure sensing member 81A used in the seventh embodiment, the pressure sensing member 81B, as illustrated in FIGS. 15(*c*) and 15(*d*), is used. Other arrangements, functions, and beneficial effects including the orifice member 16 of this embodiment, as illustrated in FIGS. 15(*a*) and 15(*b*), are the same as those in the fifth embodiment.

The pressure sensing member 813 of this embodiment is, as shown in FIGS. 15(*c*) and 15(*d*), made as being separate from the injector body. The pressure sensing member 81B is made by a metallic plate (second member) disposed substantially perpendicular to the axial direction of the injector 2 and stacked on the orifice member 16 in the lower body 11 to be retained integrally with the lower body 11.

Also, in this embodiment, the pressure sensing member 81B has the flat surface 82 placed in direct surface contact with the flat surface 162 of the orifice member 16 in the liquid-tight fashion. The pressure sensing member 81B and the orifice member 16 are substantially identical in contour thereof and attached to each other so that the inlet 16*h*, the through hole 16*p*, and the pressure control chamber 16*c* of the orifice member 16 may coincide with the sensing portion communication path 18*h*, the through hole 18*p*, and the pressure control chamber 18*c* formed in the pressure sensing member 81B, respectively. The orifice member-far side of the sensing portion communication path 18*h* opens at a location corresponding to the fuel supply branch path 11*g* diverging from the fuel supply path 11*b*.

The pressure sensing member 81B of this embodiment, unlike the pressure sensing member 81A of the ninth embodiment, has the diaphragm 18*n* made of a thin wall provided directly in the pressure control chamber 18*c*. Specifically, the diaphragm (i.e., the thin wall) 18*n* is formed between the recess (i.e., a pressure sensing chamber) 18*b* formed directly in an inner wall of the pressure control chamber 18*c* and the depression 18*g* oriented from the outer wall of the pressure sensing member 81B to the pressure control chamber 18*c*. On the bottom surface of the depression 18*b* of the diaphragm 18*n* which is opposite the pressure control chamber 18*c*, the semiconductor pressure sensor 18*f*, as illustrated in FIG. 10, is affixed integrally.

The depth of the depression 18*b* is at least greater than the thickness of the pressure sensor 18*f*. The depression 18*g* is greater in diameter than the recess 18*b* in the pressure control chamber 18*c*. The thickness of the diaphragm 18*n*, is determined by controlling the depth of the recess 18*b* and the depression 18*g* during the formation thereof.

In this embodiment, the diaphragm 18*n* is, as described above, made of the thin-walled portion of the inner wall defining the pressure control chamber 18*c*, thereby possessing the same effects as those in the tenth embodiment. Specifically, it is possible for the pressure sensor 18*f* to measure a change in pressure in the pressure control chamber 18*c* without any time lag.

Also, in this embodiment, as illustrated in FIG. 15(*e*), the outer end wall 30*p* is so disposed that it lies flush with the lower end of the recess 18*b* or is located at a distance L away from the lower end of the recess 18*b* toward the spray hole 12*b* when the spray hole 12*b* is opened. This causes the pressure of the high-pressure fuel introduced into the pressure control chamber 18*c* when the spray hole 12*b* is opened is exerted on the recess 18*b* formed in the inner wall of the pressure control chamber 18*c* without any problem, thereby ensuring the accuracy in measuring the pressure of the high-pressure fuel in the pressure control chamber 18*c* using the pressure sensor 18*f*.

Also, in this embodiment, the thin-walled portion working as the diaphragm 18*n* is formed in the inner wall of the pressure control chambers 16*c* and 18*c*. The pressure sensor 18*f* senses the displacement of the diaphragm 18*n*, thereby ensuring the accuracy in finding the time the fuel has been sprayed actually from the spray hole 12*b*.

In this embodiment, the diaphragm 18*n* is defined by the portion of the inner wall of the pressure control chambers 16*c* and 18*c*. The location of the diaphragm 18*n* is away from the inner orifice 16*b* and the outer orifice 16*a*, thereby minimizing the adverse effects of a high-speed flow of the high-pressure fuel within the inner orifice 16*b* and the outer orifice 16*a* or near openings thereof, thus enabling a change in the pressure in a region where the flow in the pressure control chambers 16*c* and 18*c* is in the steady state.

Other operations and effects are the same as in the eighth embodiment, and explanation thereof in detail will be omitted here. Also in this embodiment, the pressure sensing member 81B may be made of a metallic glass.

In this embodiment, the sensing portion communication path 18*h* corresponds to the high-pressure fuel path. The pressure sensing member 8613 defining the high-pressure fuel path corresponds to the path member. The diaphragm 18*n* formed in the pressure sensing member 863 corresponds to the thin-walled portion.

Ninth Embodiment

Figure 16:
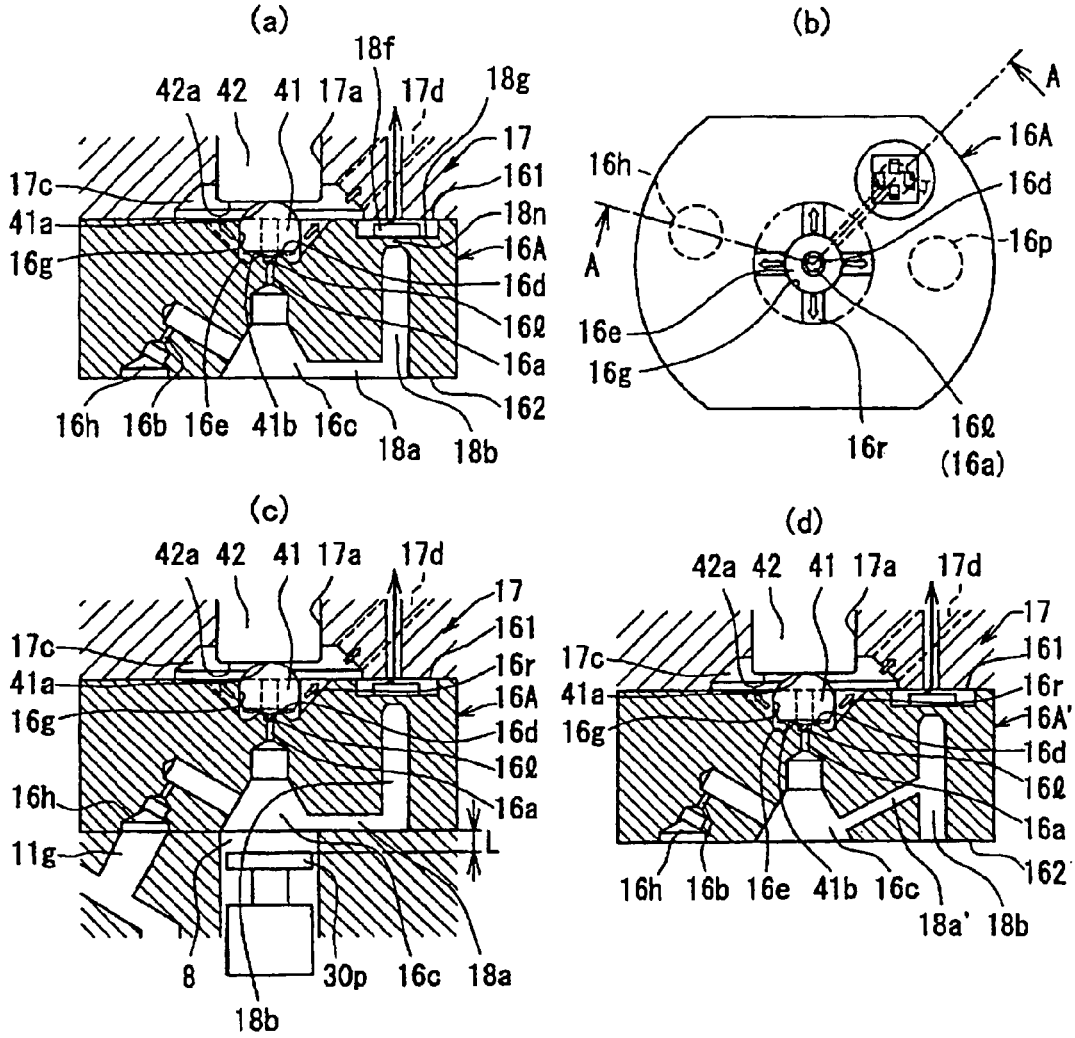
FIG. 16(*b*) is a plan view of FIG. 16(*a*)

The ninth embodiment of the invention will be described below. FIGS. 16(*a*) and 16(*b*) are a partial sectional view and a plane view which show highlights of a fluid control valve (i.e., the pressure sensing member) of an injector for a fuel injection system in the ninth embodiment. FIG. 16(*c*) is a sectional view which shows a positional relation between a control piston and the pressure sensing member when being installed in an injector body. The same reference numbers are attached to the same or similar parts to those in the fifth to eighth embodiments, and explanation thereof in detail will be omitted here.

In the fifth to eighth embodiments, the pressure sensing portions 80, 85, and 87 working to measure the pressure of the high-pressure fuel are provided in the pressure sensing members 81, 81A, 81B, and 86 which are separate from the orifice member 16. In contrast to this, this embodiment has the structure functioning as the pressure sensing portion 80 installed in the orifice member 16A (i.e., the path member).

The specific structure of the orifice member 16A of this embodiment will be described with reference to drawings. The orifice member 16A of this embodiment is, as illustrated in FIGS. 16(*a*) and 16(*b*), made of a metallic plate oriented substantially perpendicular to the axial direction of the injector 2. The orifice member 16A is formed as being separate from the lower body 11 and the nozzle body 12 defining the injector body. After formed, the orifice member 16A is installed and retained in the lower body 11 integrally.

The orifice member 16A, like the orifice member 16 of the fifth embodiment, has the inlet 16*h*, the inner orifice 16*b*, the outer orifice 16*a*, the pressure control chamber 16*c*, the valve seat 16*d*, and the fuel leakage grooves 16*r* formed therein. Their operations are the same as in the orifice member 16 of the fifth embodiment.

However, in this embodiment, the orifice member 16A is equipped with the groove 18*a* which connects the pressure sensing chamber 18*b* and the pressure control chamber 16*c* and which is formed on the flat surface 162, like the pressure sensing chamber 18*b* defined by the groove or hole formed in the flat surface 162 of the orifice member 16A on the valve 41-far side.

The depression 18*g* for installation of the semiconductor pressure sensor 18*f* is formed at a location in the valve body side end surface 161 of the orifice member 16A which corresponds to the location of the pressure sensing chamber 18*b*. In this embodiment, a portion of the orifice member 16A between the pressure sensing chamber 18*b* and the depression 18*g* on which the pressure sensor 18*f* is installed defines the diaphragm 18*n* which deforms in response to the high-pressure fuel. As illustrated in FIG. 16(*a*), the valve body 17 has formed therein a wire path through which electric wires that are signal lines extend from the pressure sensor 18*f* to the connector 50. The wire path has an opening exposed to the depression 18*f* on which the pressure sensor 18*f* is fabricated.

The surface of the diaphragm 18*n* (i.e., the bottom of the depression 18*g*) which is far from the pressure sensing chamber 18*b* is located at a depth that is at least greater than the thickness of the pressure sensor 18*f* below the valve body-side end surface of the orifice member 16A and is greater in diameter than the pressure sensing chamber 18*b*-side surface thereof. The thickness of the diaphragm 18*n* is determined during the production thereof by controlling the depth of both grooves sandwiching the diaphragm 18*n*.

The orifice 16A has the groove 18*a* formed in the flat surface 162 on the valve 41-far side thereof at a depth greater than that of the pressure sensing chamber 18*b*. The groove 18*a* communicates between the pressure control chamber 16*c* and the pressure sensing chamber 18*b*. The orifice member 16A of this embodiment is placed in surface-contact with the lower body 11, not the pressure sensing member, so that the groove 18*a* defines a combined path (a branch path below) whose wall is a portion of the upper end surface of the lower body 11. This causes the high-pressure fuel, as entering the pressure control chamber 16*c* through the groove 18*a* (i.e., the branch path) to flow into the pressure sensing chamber 18*b*.

When the orifice member 16A is laid to overlap the lower body 11, the inlet 16*h*, the through hole 16*p*, the pressure control chamber 16*c* coincide with the fuel supply path 11*g* diverging from the fuel supply path 11*b*, a bottomed hole (not shown), and the pressure control chamber 8 of the lower body 11, respectively. The inlet 16*h* and the inner orifice 16*b* of the orifice member 16A define a portion of the path extending from the fuel supply path 11*b* to the pressure control chamber 16*c*.

The adoption of the above structure in this embodiment provides the same operations and effects as those in the tenth embodiment. Particularly, in this embodiment, the orifice 16A is designed to perform the function of the pressure sensing portion, thus eliminating the need for the pressure sensing portion.

Also in this embodiment, as illustrated in FIG. 16(*c*), the outer end wall (upper end) 30*p* is so disposed that it lies flush with the lower end of the groove 18*a* or is located at a distance L away from the lower end of the groove 18*a* toward the spray hole 12*b* when the spray hole 12*b* is opened. This causes the groove 18*a* not to be blocked (partially) by the control piston 30 when the spray hole 12*b* is opened, so that the high-pressure fuel which is substantially identical in pressure level with the high-pressure fuel introduced into the pressure control chamber 16*e* to flow into the pressure sensing chamber 18*b* at all times, thereby ensuring the accuracy in measuring the pressure of the high-pressure fuel in the pressure control chamber 16*e* using the pressure sensor 18*f* without any time lag and in finding the time the fuel has been sprayed actually from the spray hole 12*b*.

Also, in this embodiment, the groove 18*a* (i.e., the branch path) is formed in the inner wall of the pressure control chamber 16*c* at a location away from the inner orifice 16*b* and the outer orifice 16*a*, thereby enabling the pressure sensor 18*f* to monitor a change in the pressure in a region where the flow in the pressure control chamber 16*c* is in the steady state. Other operations and effects are the same as those in the eighth embodiment, and explanation thereof in detail will be omitted here.

Also, in this embodiment, instead of the groove 18*a*, the hole 18*a*', as illustrated in FIG. 16(*d*), may alternatively be formed which is so inclined as to extend from the pressure control chamber 16*c* to the pressure sensing chamber 18*b*.

In this embodiment, the inlet 16*h*, the inner orifice 16*b*, the outer orifice 16*a*, the pressure control chamber 16*c*, the groove 18*a*, and the pressure sensing chamber 18*b* correspond to the high-pressure fuel path. The orifice member 16A defining the high-pressure fuel path corresponds to the path member. The diaphragm 18*n* formed in the orifice member 16A corresponds to the thin-walled portion.

Tenth Embodiment

Figure 17:
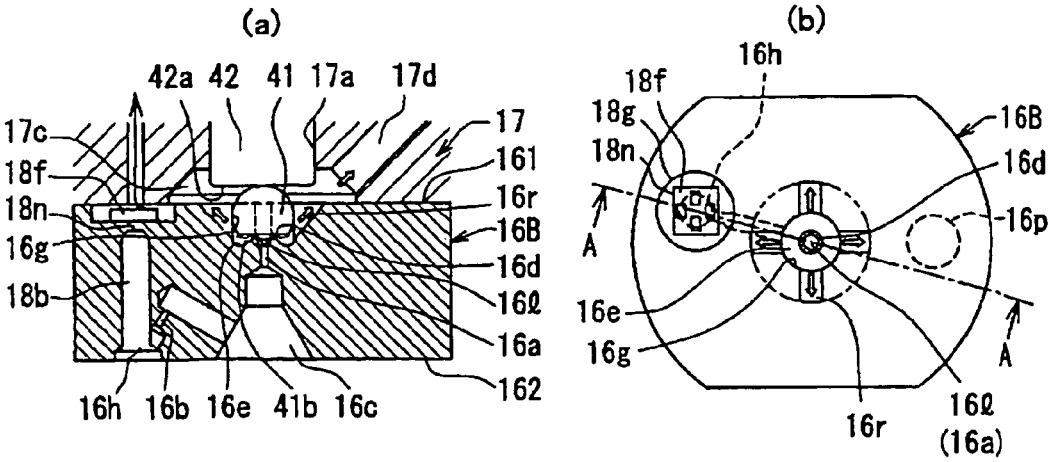
FIG. 17(*a*) is a partial sectional view which shows highlights of an orifice member (pressure sensing member) of an injector far a fuel injection device according to the tenth embodiment.

The tenth embodiment of the invention will be described below. FIGS. 17(*a*) and 17(*b*) are a partial sectional view and a plane view which show highlights of a fluid control valve (i.e., the pressure sensing member) of an injector for a fuel injection system in the tenth embodiment. The same reference numbers are attached to the same or similar parts to those in the fifth to ninth embodiments, and explanation thereof in detail will be omitted here.

The orifice member 16B (corresponding to the path member) of this embodiment is, like the orifice member 16A, designed to have the structure functioning as the pressure sensing portion 80. The lower body 11 has only the orifice member 16B installed therein without having a separate pressure sensing member.

The orifice member 16B of this embodiment is different from the orifice member 16A of the ninth embodiment in location where the pressure sensing chamber 18*b* is formed. Other arrangements are identical with the orifice member 16A of the ninth embodiment. The following discussion will refer to only such a difference.

The orifice member 16B of this embodiment is, as can be seen FIGS. 17(*a*) and 17(*b*), designed to have the pressure sensing chamber 18*b* which diverges from a fluid path extending from the inlet 16*h* opening at the flat surface 162 to introduce the fuel thereinto to the pressure control chamber 16*c* through the inner orifice 16*b*. Like this, the pressure control chamber 18*b* may be used as a branch path to introduce the high-pressure fuel thereinto before entering the pressure sensing chamber 18*b* as well as the introduction of the high-pressure fuel into the pressure sensing chamber 18*b* after entering the pressure control chamber 16*c*, like in the ninth embodiment. In either case, a special tributary needs not be provided as the branch path connecting with the fluid path extending between the inlet 16*h* and the pressure control chamber 16*c* or with the pressure control chamber 16*c*, thereby avoiding an increase in dimension of the injector body in the radial direction, i.e., the diameter thereof. The other operations and effects are the same as those in the ninth embodiment, and explanation thereof in detail will be omitted here.

The pressure sensing portions 80, 85, 87 of the fifth to eighth embodiments have been described as being forms different from each other, but however, they may be installed in a single injector. The orifice member 16A or 16B may be employed which is equipped with the pressure sensing portion 80, as described in the ninth or tenth embodiment, functioning as one(s) or all of the pressure sensing portions.

In the above case, as an example, they may be employed redundantly in order to assure the mutual reliability of the pressure sensors 18*f*. As another example, it is possible to use signals from the sensors to control the quantity of fuel to be sprayed finely. Specifically, after the fuel is sprayed, the pressure in the fuel supply path 11*b* drops microscopically from the spray hole 12*b*-side thereof. Subsequently, pulsation caused by such a pressure drop is transmitted to the fluid induction portion 21. Immediately after the spray hole 12*b* is closed, so that the spraying of fuel terminates, the pressure of fuel rises from the spray hole 12*b*-side, so that pulsation arising from such a pressure rise is transmitted toward the fluid induction portion 21. Specifically, it is possible to use a time difference between the changes in pressure on upstream and downstream sides of the fuel induction portion 21 of the fuel supply path 11*b* to control the quantity of fuel to be sprayed finely.

A single injector equipped with a plurality of pressure sensing portions which may be used for the above purposes will be described in the fifth to seventeenth embodiments.

In this embodiment, the inlet 16*h* and the pressure sensing chamber 18*b* correspond to the high-pressure fuel path. The orifice member 16B defining the high-pressure fuel path corresponds to the path member. The diaphragm 18*n* formed in the orifice member 16B corresponds to the thin-walled portion.

Eleventh Embodiment

Figure 18:
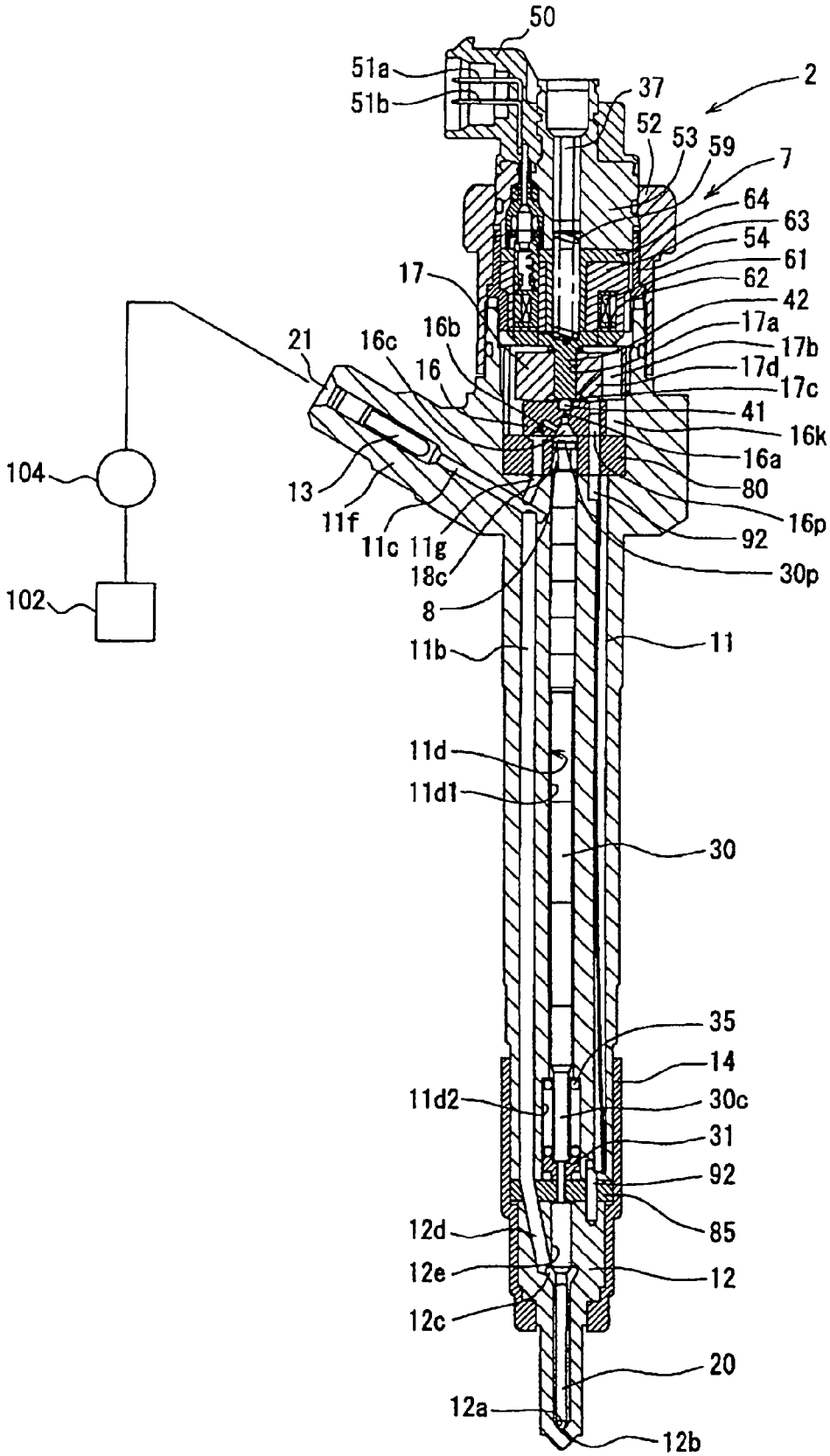
FIG. 18 is a sectional view of an injector according to the eleventh embodiment.

FIG. 18 is a sectional view which shows the injector 2 in the eleventh embodiment of the invention. The same reference numbers are attached to the same or similar parts to those in the fifth to fourth embodiments, and explanation thereof in detail will be omitted here.

This embodiment has the pressure sensing portion 80 of the fifth embodiment and the pressure sensing portion 85 of the sixth embodiment. The pressure sensing member 81 equipped with the pressure sensing portion 80 is the same one, as illustrated in FIGS. 9(*c*) and 9(*d*). The pressure sensing member 86 equipped with the pressure sensing portion 85 is the same one, as illustrated in FIGS. 13(*a*) to 13(*c*).

This embodiment is different from the fifth and sixth embodiments in that the terminal pins 51*b* of the connector 50 are implemented by the terminal pins 51*b*1 for the pressure sensing portion 80 and the terminal pins 51*b*2 for the pressure sensing portion 85 (which are not shown) in order to output both signals from the pressure sensing portion 80 and the pressure sensing portion 85.

In this embodiment, the pressure sensing portion 80 is disposed near the fuel induction portion 21. The pressure sensing portion 85 is disposed close to the spray hole 12*b*. The times when pressures of the high-pressure fuel are to be measured by the pressure sensing portions 80 and 85 are, therefore, different from each other, thereby enabling the pressure sensing portions 80 and SS to output a plurality of signals indicating changes in internal pressure thereof having occurred at different times.

Twelfth Embodiment

Figure 19:
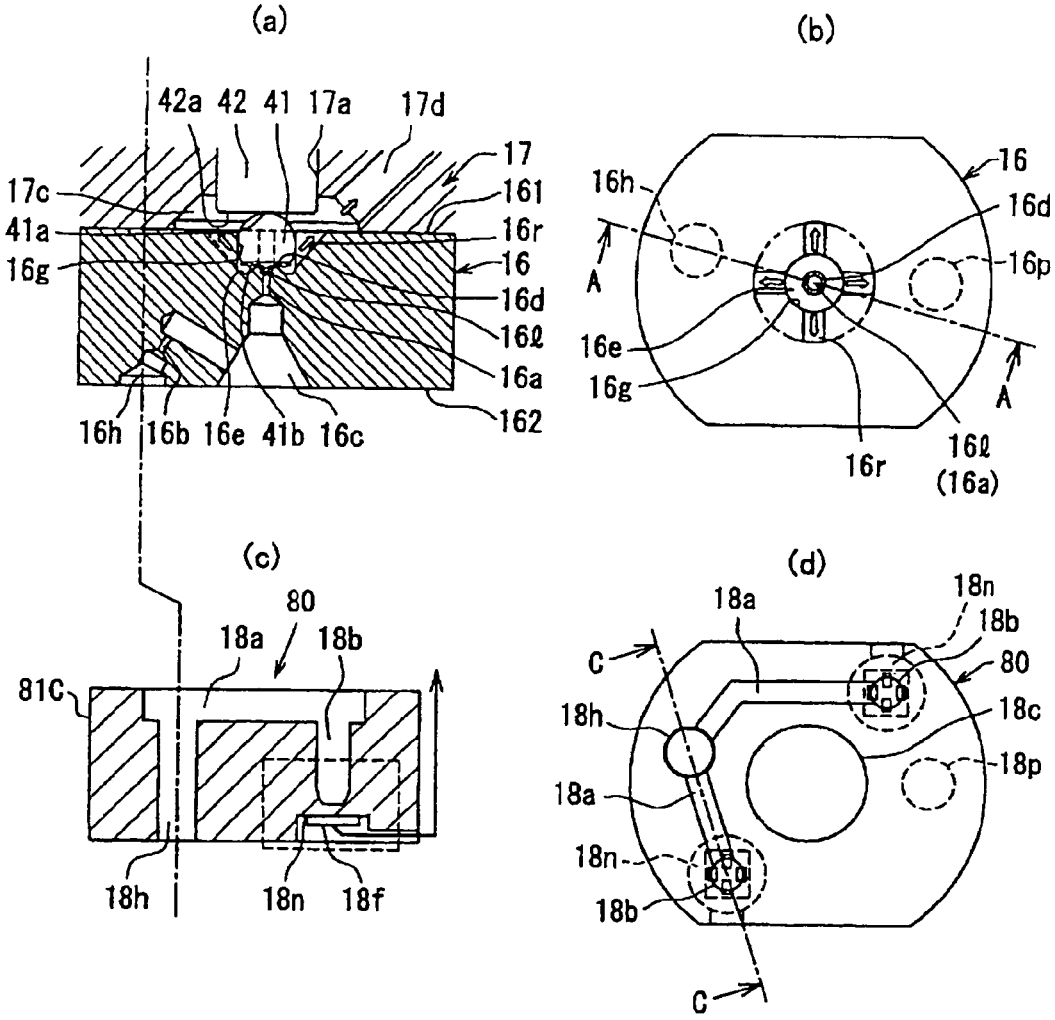
FIG. 19(*a*) is a partial sectional view which shows highlights of an orifice member according to the twelfth embodiment.

The twelfth embodiment of the invention will be described below. FIGS. 19(*a*) and 19(*b*) are a partial sectional view and a plane view which show highlights of a fluid control valve in this embodiment. FIGS. 19(*c*) and 19(*d*) are a partial sectional view and a plane view which show highlights of the pressure sensing member 81C. The same reference numbers are attached to the same or similar parts to those in the fifth to eleventh embodiments, and explanation thereof in detail will be omitted here.

This embodiment is so designed that the pressure sensing member 81 used in the fifth embodiment is, as illustrated in FIGS. 19(*c*) and 19(*d*), equipped with a plurality (two in this embodiment) of pressure sensing portions 80 (i.e., grooves, diaphragms, and pressure sensors) (first and second pressure sensing means). Other arrangements, operations, and effects including those of the orifice member 16 of this embodiment, as illustrated in FIGS. 19(*a*) and 19(*b*), are the same as those in the fifth embodiment.

The pressure sensing member 81C has formed therein two discrete grooves 18*a* (which will be referred to as first and second grooves below) communicating with the sensing portion communication path 18*h*. The first groove 18*a* communicates with the corresponding first pressure sensing chamber 18*b* to transmit its change in pressure to the first pressure sensor 18*f* through the first diaphragm. Similarly, the second groove 18*a* communicates with the corresponding second pressure sensing chambers 18*b* to transmit its change in pressure to the second pressure sensor 18*f* through the second diaphragm.

The two grooves 18*n* are, as illustrated in FIG. 19(*d*), preferably opposed diametrically with respect to the sensing portion communication path 18*h* in order to increase the freedom of design thereof. Although not illustrated, the two grooves 18*n* are preferably designed to have the same length and depth in order to ensure the uniformity of outputs from the two pressure sensors 18*f*. The grooves 18*a* may alternatively be so formed as to extend on the same side of the sensing portion communication path 18*h* (which is not shown). This permits the wires of the pressure sensors 18*f* to extend from the same side surface of the pressure sensing member 81 and facilitates the layout of the wires.

Thirteenth Embodiment

Figure 20:
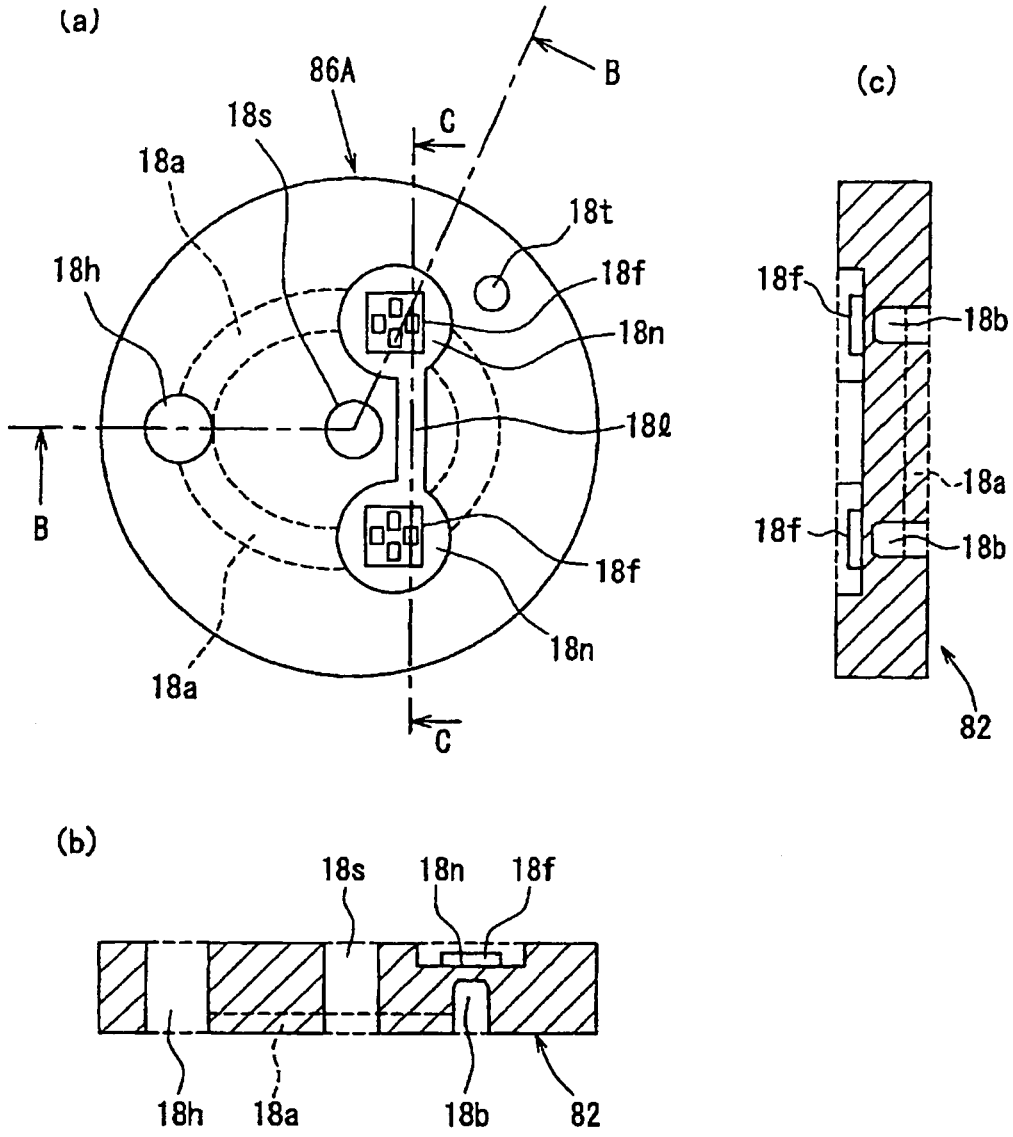
FIG. 20(*a*) a partial sectional view which shows highlights of a pressure sensing member according to the thirteenth embodiment.

The thirteenth embodiment of the invention will be described below. FIGS. 20(*a*) to 20(*c*) are a plan view and partial sectional views which show highlights of the pressure sensing member 86A of this embodiment. The same reference numbers are attached to the same or similar parts to those in the fifth to twelfth embodiments, and explanation thereof in detail will be omitted here.

The thirteenth embodiment is so designed that the pressure sensing member 86 used in the sixth embodiment is, as illustrated in FIGS. 20(*a*) to 20(*c*), equipped with a plurality (two in this embodiment) of pressure sensing portions 85 (i.e., grooves, diaphragms, and pressure sensors) (first and second pressure sensing means). Other arrangements, operations, and effects including those of the orifice member 16 of this embodiment are the same as those in the sixth embodiment.

The pressure sensing member 86A has formed therein two discrete grooves 18*a* (which will be referred to as first and second grooves below) communicating with the sensing portion communication path 18*h*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are as illustrated in FIG. 2(*a*), preferably opposed diametrically with respect to the sensing portion communication path 18*h* in order to increase the freedom of design thereof. The two grooves 18*n* are, like in the twelfth embodiment, preferably designed to have the same length and depth in order to ensure the uniformity of outputs from the two pressure sensors 18*f*.

The two chambers of the pressure sensing member 86A on the side where the pressure sensors 18*f* are disposed are connected to each other through the connecting groove 18*l*. This facilitates the ease of layout of electric wires from the pressure sensors 18*f* through the connecting groove 18*l*.

Fourteenth Embodiment

Figure 21:
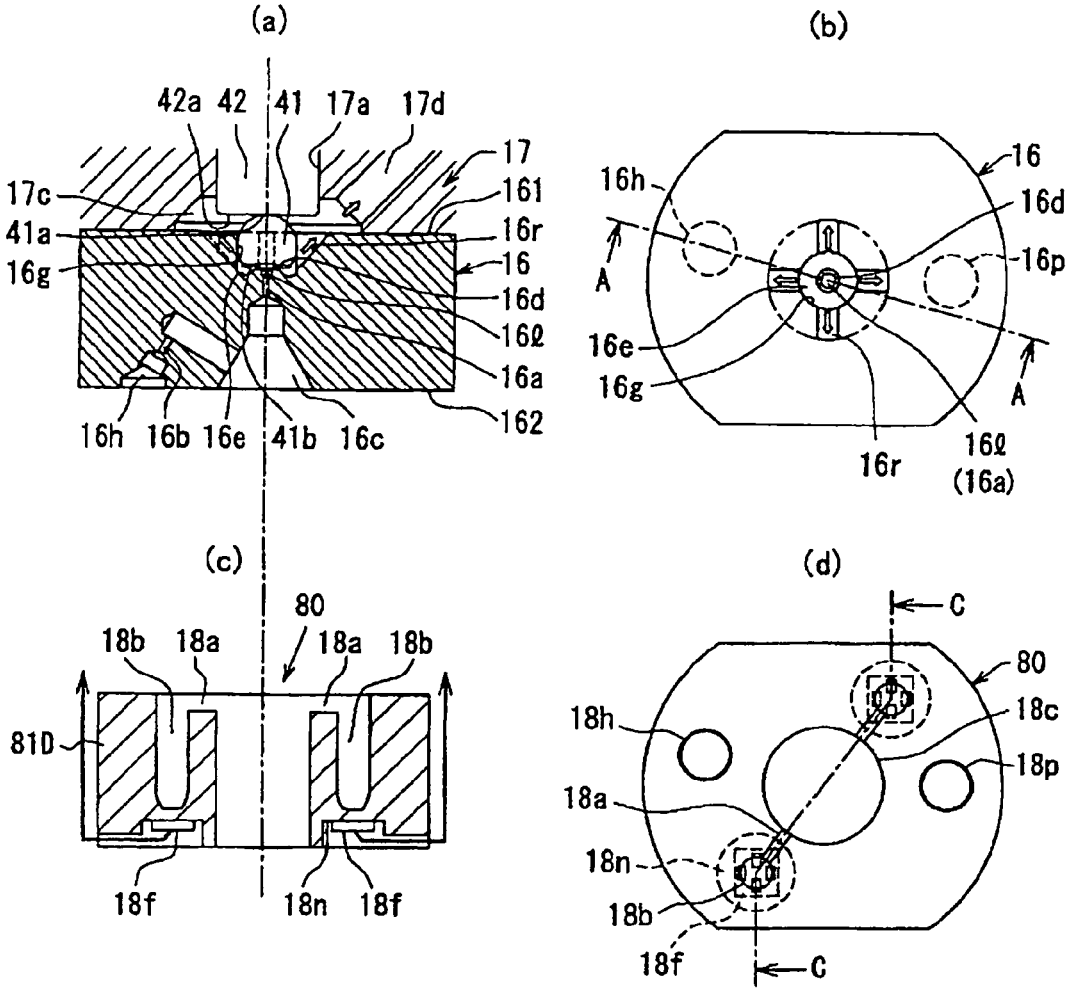
FIG. 21(*a*) is a partial sectional view which shows highlights of an orifice member according to the fourteenth embodiment.

The fourteenth embodiment of the invention will be described below. FIGS. 21(*a*) and 21(*b*) are a partial sectional view and a plan view which show highlights of a fluid control valve of this embodiment. FIGS. 21(*c*) and 21(*d*) are a partial sectional view and a plan view which show highlights of the pressure sensing member 81D. The same reference numbers are attached to the same or similar parts to those in the fifth to thirteenth embodiments, and explanation thereof in detail will be omitted here.

The fourteenth embodiment is so designed that the pressure sensing member 81A used in the seventh embodiment is, as illustrated in FIGS. 21(*c*) and 21(*d*), equipped with a plurality (two in this embodiment) of pressure sensing portions 80 (i.e., grooves, diaphragms, and pressure sensors) (first and second pressure sensing means). Other arrangements, operations, and effects including those of the orifice member 16 of this embodiment are the same as those in the seventh embodiment.

The pressure sensing member 81D has formed therein two discrete grooves 18*a* (which will be referred to as first and second grooves below) communicating with the pressure control chamber 18*c*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are preferably opposed diametrically with respect to the pressure control chamber 18*c* order to increase the freedom of design thereof.

The grooves 18*a* may alternatively be so formed as to extend on the same side of the pressure control chamber 18*c* (not shown). This permits the wires of the pressure sensors 18*f* to extend from the same side surface of the pressure sensing member 81D and facilitates the layout of the wires.

In this embodiment, the grooves 18*a* define paths along with the flat surface 162 of the orifice member 16, but however, the pressure sensing member 81D may be turned upside down. In this case, paths are defined between the grooves 18*a* and the flat surface (not shown) of the lower body 11. The first and second pressure sensors 18*f* are disposed on the orifice member 16-side.

Fifteenth Embodiment

Figure 22:
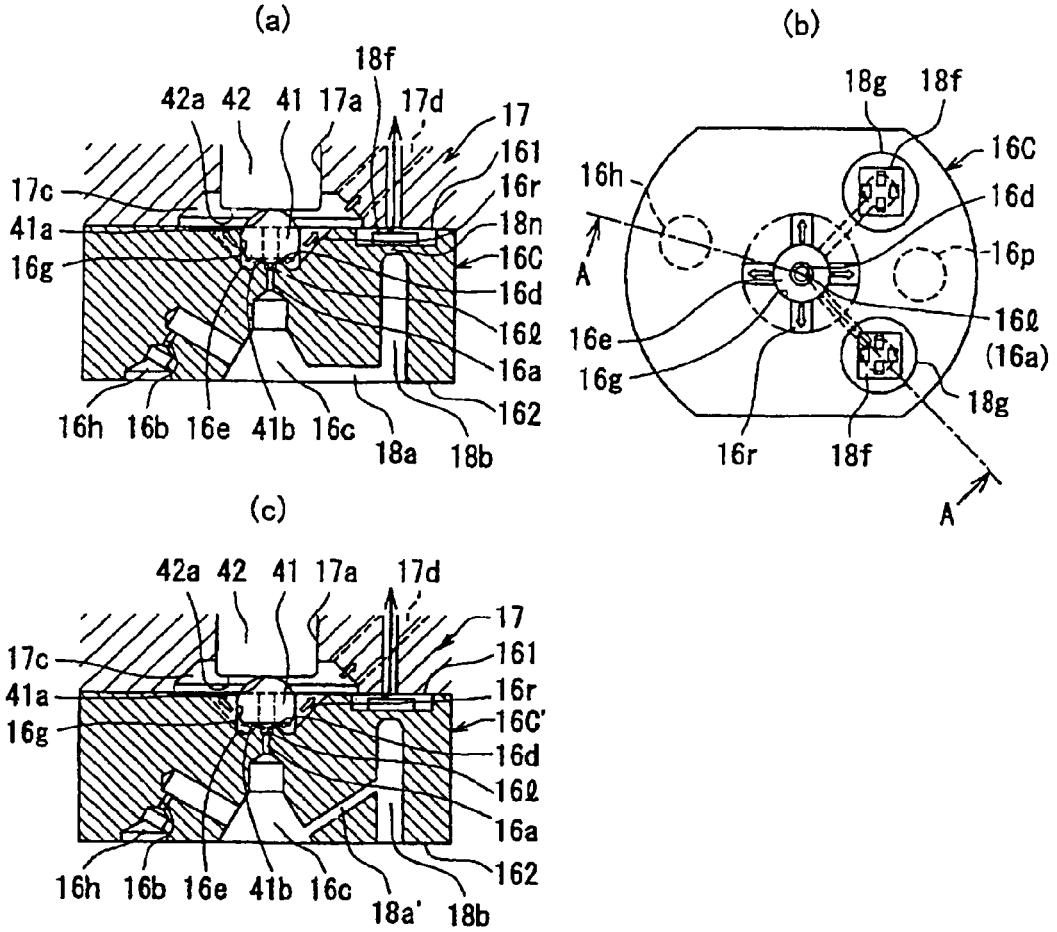
FIG. 22(*a*) is a partially sectional view which shows highlights of an orifice member (pressure sensing member) according to the fifteenth embodiment.

The fifteenth embodiment of the invention will be described below. FIGS. 22(*a*) and 22(*b*) are a partial sectional view and a plan view which show highlights of a fluid control valve (i.e., an orifice member) 16C of this embodiment. The same reference numbers are attached to the same or similar parts to those in the fifth to fourteenth embodiments, and explanation thereof in detail will be omitted here.

The fifteenth embodiment is so designed that the orifice member 16A having the structure of the pressure sensing portion 80 used in the ninth embodiment is, as illustrated in FIGS. 22(*a*) and 22(*b*), equipped with a plurality (two in this embodiment) of pressure sensing portions 80 (i.e., grooves, diaphragms, and pressure sensors) (first and second pressure sensing means). Other arrangements, operations, and effects are the same as those in the ninth, embodiment.

The orifice member 16C has formed therein two discrete grooves 18*a* (which will be referred to as first and second grooves below) communicating with the pressure control chamber 16*c*. The first groove 18*a* communicates with the corresponding first pressure sensing chamber 18*b* to transmit its change in pressure to the first pressure sensor 18*f* through the first diaphragm 18*n*. Similarly, the second groove 18*a* communicates with the corresponding second pressure sensing chambers 18*b* to transmit its change in pressure to the second pressure sensor 18*f* through the second diaphragm 18*n*.

The two grooves 18*n* are, as illustrated in FIG. 22(*b*), preferably opposed diametrically with respect to the pressure control chamber 16*c* order to increase the freedom of design thereof.

The grooves 18*a* may alternatively be so formed as to extend on the same side of the pressure control chamber 16*c* (not shown). This permits the wires of the pressure sensors to extend from the same side surface of the orifice member 16C and facilitates the layout of the wires.

Also, in this embodiment, instead of the groove 18*a*, a hole 18', as illustrated in FIG. 22(*c*), may be formed which is so inclined as to extend from the pressure control chamber 16*c* to the pressure sensing chamber 18*b*.

Sixteenth Embodiment

Figure 23:
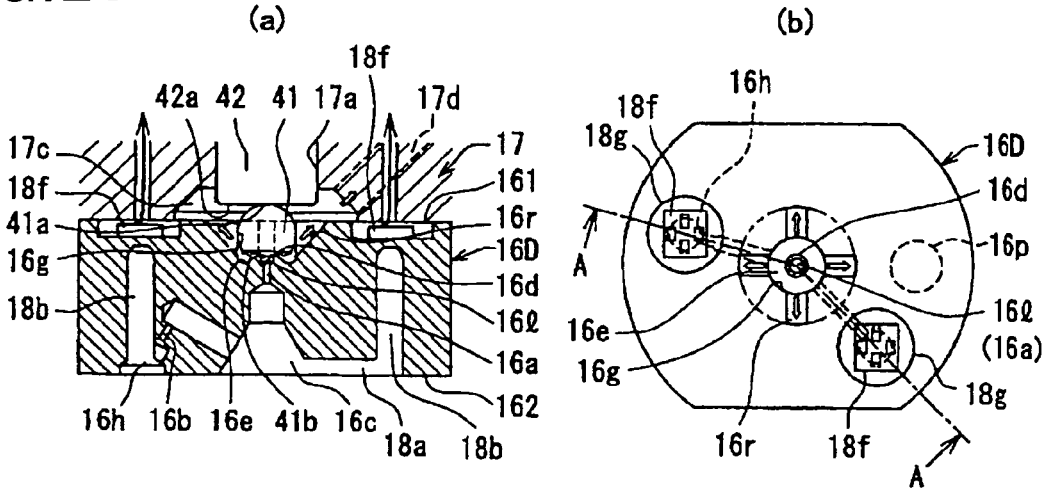
FIG. 23(*a*) is a partial sectional view which shows highlights of an orifice member (pressure sensing member) according to the sixteenth embodiment.

The sixteenth embodiment of the invention will be described below. FIGS. 23(*a*) and 23(*b*) are a partial sectional view and a plan view which show highlights of a fluid control valve (i.e., an orifice member) 16D of this embodiment. The same reference numbers are attached to the same or similar parts to those in the sixth to eighteenth embodiments, and explanation thereof in detail will be omitted here.

The sixteenth embodiment is so designed as to have both the pressure sensing portions of the ninth and tenth embodiments. Specifically, the orifice member 16D of this embodiment has formed therein the first pressure sensing chamber 18*b* communicating with the pressure control chamber 16*c* through the groove 18*a* and the second pressure sensing chamber 18*b* diverging from a fluid path extending from the inlet 16*h* to which the fuel is inputted to the pressure control chamber 16*c* through the inner orifice 16*b*. The first and second diaphragms 18*n* and the first and second pressure sensors 18*f* are disposed at locations corresponding to the first and second pressure sensing chambers 18*b*.

This embodiment has disposed between the first and second pressure sensing chambers 18*b* the inner orifice 16*b* which is smaller in diameter than the branch path, thereby causing times when the pressure changes in the first and second pressure sensing chambers 18*b* to be shifted from each other. Other arrangements, operations, and effects are the same as those in the ninth and tenth embodiments.

Other Embodiments

Each of the above embodiments may be modified as follows. The invention is not limited to the contents of the embodiments. The features of the structures of the embodiments may be combined in various ways.

In the above embodiments, the strain gauge 60*z* is attached to the outside of the thin-walled portions 70*bz*, 43*bz*, 4*cz*, and 43*dz* (i.e., the side far from the high-pressure fuel path), but however, it may alternatively be affixed to the inside of the thin-walled portions 70*bz*, 43*bz*, 4*cz*, and 43*dz* (i.e., the side closer to the high-pressure fuel path). In this case, a taking-out hole needs to be formed in the injector body 4*z* to take lead wires (not shown) of the strain gauge 60*z* from inside to outside the high-pressure fuel path.

In the second to fourth embodiments, the injector INJz may be joined directly to the high-pressure pipe 502 without through the connector 70*z*.

In the first embodiment, the thin-walled portion 70*b* is formed at a middle location of the connector 70*z* in the axial direction, but however, it may alternatively be formed in an end of the connector 70*z*.

The thin-walled portions 70*bz*, 43*bz*, 4*cz*, and 43*dz* in the above embodiments are formed in a portion of the connector 70*z* or the injector body 4*z* in the circumferential direction thereof, but however, the thin-walled portion 70*bz* may alternatively be so formed as to extend in the circumferential direction in the form of an annular shape.

In the first embodiment, the measured value of the pressure is corrected based on the temperature of the fuel, as detected by the temperature sensor 80*z*, but however, it may alternatively be corrected based on a directly-measured temperature of the thin-walled portion 70*bz* or the strain gauge 60*z*.

In the first embodiment, the temperature characteristic values and the fuel pressure characteristic values are stored in the QR code 90*z* for values of the pressure, as measured by the strain gauge 60*z*, but however, an IC chip may be attached to the injector INJz for storing them instead of the QR code 90*z*.

In the above embodiments, the invention is used with the injector INJz for diesel engines, but may be used with direct injection gasoline engines which inject the fuel directly into the combustion chamber E1*z*.

The invention claimed is:

1. A fuel pressure measuring device for use in a fuel injection system for an internal combustion engine which supplies fuel from an accumulator in which the fuel is accumulated to a fuel injection valve through a high-pressure pipe and sprays the fuel from a spray hole formed in a nozzle body of the fuel injection valve, the fuel pressure measuring device comprising:

a thin-walled portion which is formed in the nozzle body defining a high-pressure fuel path which communicates between an inlet of the fuel injection valve into which the fuel is inputted and the spray hole of the fuel injection valve and through which the fuel flows to the spray hole which is opened by a needle to be moved within the nozzle body to spray the fuel, the thin-walled portion being defined by a locally thin wall thickness of the path member and the thin-walled portion having a first and a second surface opposed to each other through a thickness of the thin-walled portion, the first surface being directly exposed to the fuel flowing through the high-pressure fuel path; and a strain sensor which is attached to the second surface of the thin-walled portion to measure strain of the thin-walled portion arising from pressure of the flowing fuel in the high-pressure fuel path when the spray hole is opened to spray the fuel by the needle being moved within the nozzle body.

2. A fuel pressure measuring device as set forth in claim 1, characterized in that the thin-walled portion is formed in a portion of the path member which define one of side surfaces of the high-pressure fuel path.

3. A fuel pressure measuring device as set forth in claim 1, characterized in that the fuel injection valve has a body defining a portion of the high-pressure fuel path, and the thin-walled portion is formed in the body.

4. A fuel pressure measuring device as set forth in claim 1, characterized in that it comprises storage means for storing a relation between an actual pressure of fuel when supplied to said high-pressure fuel path and a resulting value, as measured by the strain sensor, as a fuel pressure characteristic value.

5. A fuel pressure measuring device as set forth in claim 1, characterized in that it comprises storage means for storing a relation between a temperature of the thin-walled portion or a temperature correlating thereto and a resulting value, as measured by the strain sensor, as a temperature characteristic value.

6. A fuel pressure measuring system equipped with at least one of a fuel injection valve which is installed in an internal combustion engine and sprays fuel from a spray hole and a high-pressure pipe which supplies high-pressure fuel to said fuel injection, and the fuel measuring device, as set forth in claim 1.

7. A fuel pressure measuring device as set forth in claim 1, characterized in that it comprises a temperature sensor working to measure a temperature of the thin-walled portion or a temperature correlating thereto, and a value measured by the strain sensor is corrected as a function of a value measured by the temperature sensor.

8. A fuel pressure measuring device as set forth in claim 7, characterized in that the temperature sensor is installed in the high-pressure fuel path or the accumulator to measure the temperature of the fuel.

9. A fuel pressure measuring device as set forth in claim 8, characterized in that the temperature sensor is installed in the accumulator to measure the temperature of the fuel in the accumulator.

* * * * *